US005723952A

United States Patent [19]

Matsumoto et al.

[11] Patent Number: 5,723,952

[45] Date of Patent: Mar. 3, 1998

[54] RARE GAS DISCHARGE FLUORESCENT LAMP DEVICE

[75] Inventors: Sadayuki Matsumoto; Takeo Saikatsu; Takehiko Sakurai; Masao Karino; Hiroyoshi Yamazaki, all of Kanagawa, Japan

[73] Assignee: Mitsubishi Denki Kabushiki Kaisha, Tokyo, Japan

[21] Appl. No.: 925,497

[22] Filed: Aug. 5, 1992

Related U.S. Application Data

[62] Division of Ser. No. 710,555, Jun. 5, 1991, Pat. No. 5,173,642.

[30] Foreign Application Priority Data

Jun. 6, 1990 [JP] Japan ..... 2-147694

[51] Int. Cl.[6] ..... H05B 37/00

[52] U.S. Cl. ..... 315/205; 315/290; 315/291

[58] Field of Search ..... 315/289, 290, 315/205, 291, 209

[56] References Cited

U.S. PATENT DOCUMENTS

| | | | |
|---|---|---|---|
| 2,622,221 | 12/1952 | Beese | 313/109 |
| 3,745,411 | 7/1973 | Polman et al. | 315/172 |
| 4,388,563 | 6/1983 | Hyltin | 315/205 |
| 4,450,385 | 5/1984 | Buhrer | 315/205 |
| 4,766,350 | 8/1988 | Husgen et al. | 315/207 |
| 4,882,520 | 11/1989 | Tsunekawa et al. | 313/643 |
| 4,912,375 | 3/1990 | Deglon et al. | 315/289 |
| 4,914,347 | 4/1990 | Osawa et al. | 313/485 |
| 5,034,661 | 7/1991 | Sakurai et al. | 315/207 |

FOREIGN PATENT DOCUMENTS

| | | |
|---|---|---|
| 0 399 428 | 11/1990 | European Pat. Off. . |
| 32 31 939 | 3/1983 | Germany . |
| 63-58752 | 3/1988 | Japan . |
| 2 119 184 | 11/1983 | United Kingdom . |

*Primary Examiner*—Robert Pascal
*Assistant Examiner*—Michael Shingleton
*Attorney, Agent, or Firm*—Burns, Doane, Swecker & Mathis, LLP

[57] ABSTRACT

The present invention provides a rare gas discharge fluorescent lamp device which is long in life and high in brightness and efficiency. The lamp device basically comprises a rare gas discharge fluorescent lamp wherein rare gas is enclosed in the inside of a glass bulb which has a fluorescent layer formed on an inner face thereof and has a pair of electrodes at the opposite ends thereof. In one embodiment, it further comprises a dc power source and a resonance circuit for generating pulse-like voltage across the pair of electrodes having the time rate of energization time to a period higher than 5% but lower than 70% and the energization time within a period shorter than 150 μsec, and in another embodiment, it further comprises a high-frequency ac power source and an electric voltage generating means; to generate pulse-like voltage across a pair of electrodes of the lamp wherein an energization time of the pulse-like voltage is equal to a half period of a wave form applied from ac power source and the idle time integral-number times as long as the half period of the wave form applied from the ac power source.

6 Claims, 24 Drawing Sheets

(A) RECTANGULAR WAVE DC PULSE LIGTING
(B) HIGH-FREQUENCY AC SINE-WAVE LIGTING

IDLE TIME 100μsec

RARE GAS DISCHARGE FLUORESCENT LAMP DEVICE

This application is a divisional, of application Ser. No. 07/710,555, filed Jun. 5, 1991 now U.S. Pat. No. 5,175,692.

BACKGROUND OF THE INVENTION

1. Field of the Invention

The present invention relates to a rare gas discharge fluorescent lamp device for use with an information device such as a facsimile, a copying machine or an image reader.

2. Description of the Prior Art

In recent years, the performances of information terminal devices such as a facsimile, a copying machine and a image reader have been improved together with advancement of the information-oriented society, and the market of such information devices is rapidly expanding. In developing information devices of a higher performance, a light source unit for use with such information devices is required to have a higher performance as a key device thereof. Conventionally, halogen lamps and fluorescent lamps have been employed frequently as lamps for use with such light source units. However, since halogen lamps are comparatively low in efficiency, fluorescent lamps which are higher in efficiency are used principally in recent years.

However, while a fluorescent lamp is high in efficiency, it has a problem that characteristics thereof such as an optical output characteristic vary in accordance with a temperature since discharge from vapor of mercury is utilized for emission of light. Therefore, when a fluorescent substance is used, either the temperature range in use is limited, or a heater is provided on a wall of a tube of the lamp in order to control the temperature of the lamp. However, development of fluorescent lamps having stabilized characteristics are demanded eagerly for diversification of locations for use and for improvement in performance of devices. From such background, development of a rare gas discharge fluorescent lamp which makes use of emission of light based on rare gas discharge and is free from a change in temperature characteristic is being proceeded as a light source for an information device.

FIGS. 26 and 27 show an exemplary one of conventional rare gas discharge fluorescent lamp devices which is disclosed, for example, in Japanese Patent Laid-Open No. 63-58752, and wherein FIG. 26 is a constructional view showing a transverse section of a rare gas discharge fluorescent lamp and an entire construction of the device, and FIG. 27 is a vertical sectional view of the lamp. Referring to the figures, reference numeral 1 denotes a bulb in the form of an elongated hollow rod, which is made of quartz or hard or soft glass. A fluorescent layer 2 is formed on an inner face of the bulb 1, and rare gas X consisting of at least one of xenon, krypton, argon, neon, helium and so forth is enclosed in the bulb 1. A pair of inner electrodes 3*a* and 3*b* having different polarities from each other are located at the opposite end portions within the bulb 1. The inner electrodes 3*a* and 3*b* are individually connected to a pair of lead wires 4 which extend in an airtight condition through walls of the end portions of the bulb 1. Further, an outer electrode 5 in the form of a belt is provided on an outer face of a side wall of the bulb 1 and extends in an axial direction of the bulb 1.

The inner electrodes 3*a* and 3*b* are connected by way of the lead wires 4 to a high frequency inverter 6 serving as a high frequency power generating device, and the high frequency inverter 6 is connected to a dc power source 7. Then, the outer electrode 5 is connected to the high frequency inverter 6 such that it may have the same polarity as the one inner electrode 3*a*.

Operation is described subsequently. With the rare gas discharge fluorescent lamp device having such a construction as described above, if a high frequency power is applied across the inner electrodes 3*a* and 3*b* by way of the high frequency inverter 6, then glow discharge will take place between the inner electrodes 3*a* and 3*b*. The glow discharge will excite the rare gas within the bulb 1 so that the rare gas will emit peculiar ultraviolet rays therefrom. The ultraviolet rays will excite the fluorescent layer 2 formed on the inner face of the bulb 1. Consequently, visible rays of light are emitted from the fluorescent layer 2 and discharged to the outside of the bulb 1.

Meanwhile, another rare gas discharge fluorescent lamp is disclosed as an example in Japanese Patent Laid-Open No. 63-248080. The lamp employs such a hot cathode electrode as disclosed, for example, in Japanese Patent Publication No. 63-29931 in order to eliminate the drawback of a cold cathode rare gas discharge lamp that the starting voltage is high. The rare gas discharge fluorescent lamp can provide a comparatively high output power because its power load can be increased. However, it can obtain only a considerably low efficiency and optical output as compared with a fluorescent lamp based on mercury vapor.

However, conventional rare gas discharge fluorescent lamps cannot readily attain a sufficiently high brightness as compared with fluorescent lamps employing mercury because fluorescent substance is excited to emit light by ultraviolet rays generated by rare gas discharge, and therefore, a rare gas discharge fluorescent lamp in high efficiency has been awaited. Further, since a conventional lamp adopts a hot cathode electrode, an extra power supply is not necessary for preheating the cathode electrode.

SUMMARY OF THE INVENTION

The present invention has been made to eliminate such problems as described above, and it is an object of the present invention to obtain a lamp lighting system which causes a rare gas discharge fluorescent lamp to light in a high brightness and in a high efficiency.

In order to attain the above object, a rare gas discharge fluorescent lamp device according to one embodiment of the present invention is constituted such that it comprises a rare gas discharge fluorescent lamp wherein rare gas such as xenon gas or the like is enclosed in the inside of a glass bulb which has a fluorescent layer formed on an inner face thereof and has a pair of electrodes at the opposite ends thereof, one of which is a cathode filament, a resonance circuit which is a parallel circuit composed of a condenser and an inductance serially connected to one end of the pair of electrodes of the rare gas discharge fluorescent lamp, a series circuit comprising a direct current power source and a parallel circuit composed of a switching element connected to an anode side of the rare gas discharge fluorescent lamp and a diode, a diode provided between the other end of the cathode filament and the anode of the rare gas discharge fluorescent lamp, and a pulse signal source that controls the switching element in such a condition that the rate of open time of the switching element to a period is higher than 5% but lower than 70% and the open time is shorter than 150 μsec within a period.

A rare gas discharge fluorescent lamp device according to another embodiment of the present invention is constituted in such a form to attain the same object that it comprises a rare gas discharge fluorescent lamp wherein rare gas is enclosed in the inside of a glass bulb which has a fluorescent layer formed on an inner face thereof and has a pair of electrodes at the opposite ends thereof, a high frequency power source for supplying frequency higher than 3 KHz but lower than 200 KHz, and an electric voltage generating means for applying pulse-like voltage across a pair of electrodes of the rare gas discharge fluorescent lamp, the pulse-like voltage having a period divided into an energization time and an idle time such that the energization time is equal to a half period of a wave form applied from the power source and the idle time is odd-number times as long as the half period of the wave form applied from the power source, wherein the electric voltage generating means comprises a switching element, a control means for controlling the switching element, and two diodes whose polarities are contrary to each other and respectively connected to the rare gas discharge fluorescent lamp in parallel, characterized in that one of the two diodes is serially connected to the switching element.

A rare gas discharge fluorescent lamp device according to still further embodiment of the present invention is constituted in such a form to attain the same object that it comprises a rare gas discharge fluorescent lamp wherein rare gas is enclosed in the inside of a glass bulb which has a fluorescent layer formed on an inner face thereof and has a pair of electrodes at the opposite ends thereof, a high frequency power source for supplying frequency higher than 3 KHz but lower than 200 KHz, and an electric voltage generating means for applying pulse-like voltage across a pair of electrodes of the rare gas discharge fluorescent lamp by alternatively changing respective polarities, the pulse-like voltage having a period divided into an energization time and an idle time such that the energization time is equal to a half period of a wave form applied from the power source and the idle time is integral-number times as long as the half period of the wave form applied from the power source, wherein the electric voltage generating means comprises two switching elements, two control means for respectively controlling the two switching elements, and two diodes whose polarities are contrary to each other and respectively connected to the rare gas discharge fluorescent lamp in parallel, characterized in that the two diodes are serially connected to the respective switching elements.

A rare gas discharge fluorescent lamp device according to one embodiment of the present invention is, for example, constructed such that an inductance is connected to one side of a cathode filament of a rare gas discharge fluorescent lamp, which inductance is connected to a condenser in parallel to form a resonance circuit, and this and a parallel circuit composed of a switching element and a diode and a direct current are connected in series, and since a diode is connected between a pair of electrodes of the rare gas discharge fluorescent lamp, during a pulse signal from a pulse signal source of the switching element is supplied to close the switching element, a preheating current flows through the diode connected between the pair of electrodes and to the cathode filament of the rare gas discharge fluorescent lamp to preheat the cathode, so that the rare gas discharge fluorescent lamp is not discharged, but when the switching element is opened, a voltage is applied across the pair of electrodes by the resonance circuit, and converted to a half wave voltage of ac sine wave which is necessary for lighting the rare gas discharge fluorescent lamp, so that the lamp is discharged. By the way, since the rate of energization time of the rare gas discharge fluorescent lamp to a period caused by opening the switching circuit is higher than 5% but lower than 70% and the energization time within a period is shorter than 150 μsec, the probability that molecules of the enclosed gas may be excited at such an energy level that they may emit much resonant ultraviolet rays of the rare gas which contributes to emission of light upon application of such pulse-like voltage. Furthermore, since an electric current flows to the cathode filament during the closed period of the switching element, the filament can be preheated without any additional preheating power supply.

Further, since a rare gas discharge fluorescent lamp device according to another embodiment is constructed such that a pulse-like voltage generating means supplies a pulse-like voltage across a pair of electrodes of the rare gas discharge fluorescent lamp wherein an energization time of the pulse-like voltage is equal to a half period of a wave form applied from the power source and the idle time is odd-number times as long as the half period of the wave form applied from the power source, the probability that molecules of the enclosed gas may be excited at such an energy level that they may emit much resonant ultraviolet rays of the rare gas which contributes to emission of light can be increased, so that the optical output and efficiency of the lamp are improved.

Furthermore, since a rare gas discharge fluorescent lamp device according to still further embodiment of the present invention is constructed such that a pulse-like voltage generating means supplies a pulse-like voltage across a pair of electrodes of the rare gas discharge fluorescent lamp wherein an energization time of the pulse-like voltage is equal to a half period of a wave form applied from the power source and the idle time integral-number times as long as the half period of the wave form applied from the power source, the probability that molecules of the enclosed gas may be excited at such an energy level that they may emit much resonant ultraviolet rays of the rare gas which contributes to emission of light can be increased, so that the optical output and efficiency of the lamp are improved.

Other objects and features of the invention will be more fully understood from the following detailed description and appended claims when taken in conjunction with the accompanying drawings.

BRIEF DESCRIPTION OF THE DRAWINGS

FIG. 1 is an entire constructional view of the rare gas discharge fluorescent lamp device showing one embodiment;

FIG. 2 is a lamp efficiency characteristic view with respect to an enclosed xenon gas pressure in the device;

FIG. 3 is a starting voltage characteristic view with respect to an enclosed xenon gas pressure;

FIG. 4 is a lamp efficiency characteristic view with respect to a pulse generation time of the lamp in which xenon gas is enclosed;

FIG. 5 is a lamp efficiency characteristic view with respect to a pulse duty ratio of the lamp in which xenon gas is enclosed;

FIG. 6 is a life characteristic view with respect to a pulse duty ratio of the lamp in which xenon gas is enclosed;

FIG. 7 is a lamp efficiency characteristic view with respect to an enclosed krypton gas pressure;

FIG. 8 is a starting voltage characteristic view with respect to an enclosed krypton gas pressure of the device;

FIG. 9 is a lamp efficiency characteristic view with respect to a pulse energization time of the lamp wherein krypton gas is enclosed;

FIG. 10 is a lamp efficiency characteristic view with respect to a pulse duty ratio of the lamp in which krypton gas is enclosed;

FIG. 11 is a life characteristic view with respect to a duty ratio of the lamp wherein krypton gas is enclosed;

FIG. 12 is a block diagram showing a rare gas discharge fluorescent lamp having a noiseless characteristic according to another embodiment of the present invention; and FIG. 13 is a block diagram showing a rare gas discharge fluorescent lamp device for lighting multiple lamps according to another embodiment of the present invention.

FIG. 14 is a block diagram showing the rare gas discharge fluorescent lamp device according to this embodiment;

FIG. 15 shows a relationship between ac wave form and output of the applied voltage;

FIG. 16 is a characteristic view showing a relationship between the enclosed gas pressure and lamp efficiency in this embodiment;

FIG. 17 is a characteristic view showing a relationship between idle period and lamp efficiency;

FIG. 18 is a characteristic view showing a relationship between ac frequency and lamp efficiency; and FIG. 19 is a block diagram showing a rare gas discharge fluorescent lamp according to another embodiment.

FIG. 20 is a block diagram showing the rare gas discharge fluorescent lamp device according to this embodiment;

FIG. 21 shows a relationship between ac wave form and output of the applied voltage;

FIG. 22 is a characteristic view showing a relationship between the enclosed gas pressure and lamp efficiency in this embodiment;

FIG. 23 is a characteristic view showing the relationship between idle period and lamp efficiency in this embodiment;

FIG. 24 is a characteristic view showing the relationship between ac frequency and lamp efficiency;

FIG. 25 is a block diagram showing a rare gas discharge fluorescent lamp according to further embodiment of the present invention;

DETAILED DESCRIPTION OF THE PREFERRED EMBODIMENTS

Figure 1:
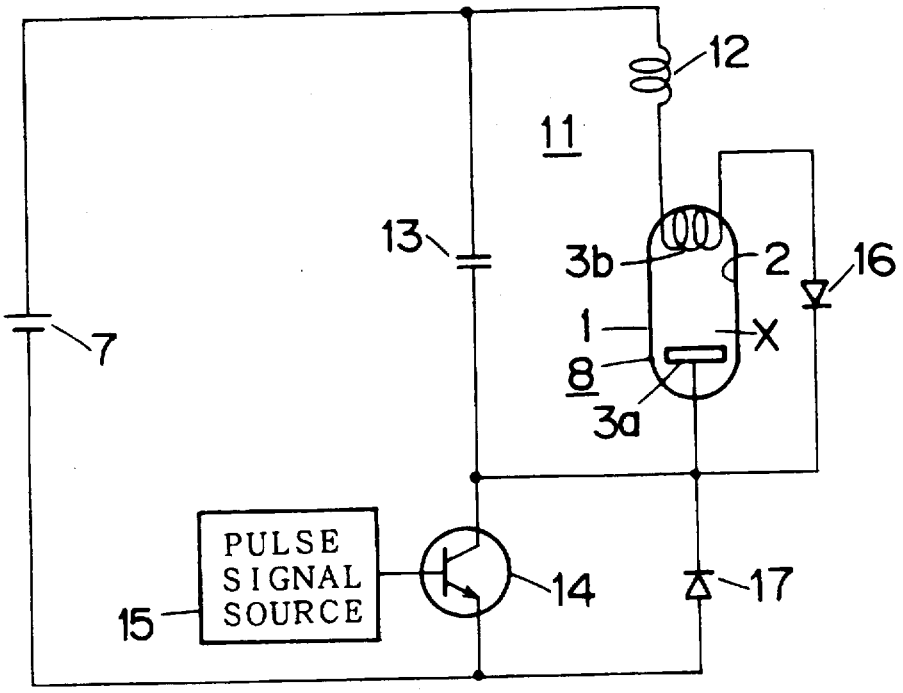
FIGS. 1 to 13 are drawings corresponding to a rare gas discharge fluorescent lamp device according to one embodiment of the present invention.

In the following, an embodiment of the present invention is described with reference to the drawings. By the way, it is to be noted that like reference characters in each figure denote like or corresponding portions of the conventional embodiment so as to avoid repetition of the explanation.

FIG. 1 is an entire constructional view of an embodiment of the present invention. Reference numeral 8 denotes a rare gas discharge fluorescent lamp (hereinafter referred to as a lamp) wherein a fluorescent layer 2 is formed on a substantially entire inner peripheral surface of a bulb 1 made of glass and having a straight cylindrical configuration having a diameter of 15.5 mm and a length of 300 mm, and rare gas X such as xenon gas is enclosed in the bulb 1. A pair of electrodes 3*a* and 3*b* are encapsulated at the opposite end portions in the bulb 1. An aluminum plate having a width of 3 mm is adhered as an auxiliary starting conductor to an outer wall of the bulb 1 over the overall length of the lamp. Reference numeral 7 denotes a dc power source. Reference numeral 11 denotes a resonance circuit composed of an inductance 12 and a condenser 13, and 14 denotes a switching circuit such as a transistor, 15 denotes a pulse signal source that generates pulse signals for opening and closing operation of the switching element 14, and 16, 17 denote diodes, wherein the diode 16 is connected between a pair of electrodes 3*a* and 3*b* of the rare gas discharge fluorescent lamp, whereas the diode 17 is connected to the switching element 14 in parallel.

The operation of the above construction is as follows. In the rare gas discharge fluorescent lamp device as shown in FIG. 1, the switching element 14 is opened or closed during a period and a term predetermined in accordance with the period and width of the pulse signal supplied from the pulse signal source 15. During the period that the switching element 14 is closed, a dc current from the power source 7 flows to the parallel resonance circuit 11, and further flows to a series circuit comprising the inductance 12, the cathode 3*b*, the diode 16 and the switching element 14, so that the cathode 3*b* is preheated. Whereafter when the switching element 14 is opened, a voltage is applied across the electrodes 3*a* and 3*b* by means of a resonance phenomenon of the parallel resonance circuit 11 and the lamp 8 is thereby discharged. Since the voltage generated by the parallel resonance circuit 11 is a ac sine-wave voltage, the switching element 14 is opened for a half period of the resonance period, and then the switching element 14 is again closed. Accordingly, the discharge conducted within the lamp 8 is converted to a pulse-like discharge of a half wave voltage of ac sine wave having idle time therein. The diode 17 connected to the switching element 14 in parallel is provided for protecting the switching element 14 itself.

Subsequently, referring to an examination of the above rare gas discharge fluorescent lamp device in which each of xenon, krypton and argon gas is enclosed in a glass bulb 1 and intermitting lighting of the lamp 8 is conducted, an explanation regarding the relationship among the pressure of each of the above enclosed gas, the rate of an energization time within a period (hereinafter referred to as duty ratio), the energization time, the lamp efficiency, starting voltage and the lifespan thereof is given as below.

Figure 2:
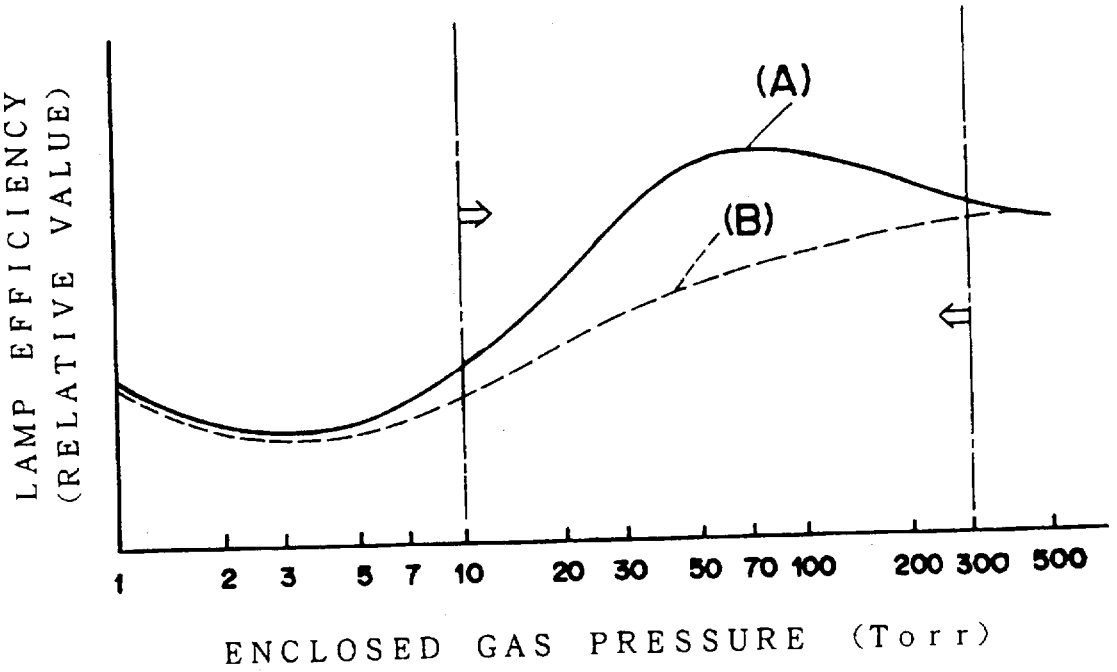
Figure 3:
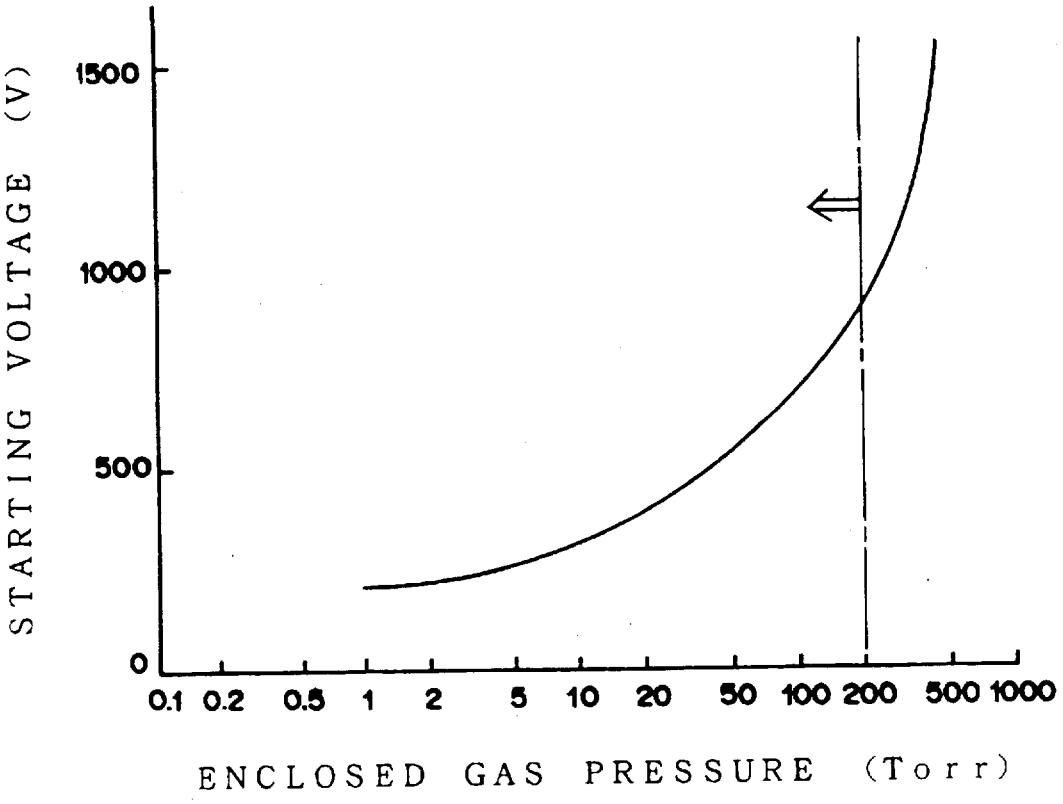

FIG. 2 shows a relationship between a pressure of enclosed xenon gas and a lamp efficiency. It is to be noted that the lamp efficiency is determined from a value obtained by dividing a brightness by an electric power. In FIG. 2, "A" indicates the relationship when the rare gas discharge fluorescent lamp is lit by rectangular wave dc pulses having a duty ratio of 60%, while "B" indicates the relationship in the case of common high frequency ac lighting (sine wave), and in both cases, the frequency is 20 KHz and the power consumption is the same. It can be seen that, at an enclosed gas pressure lower than 10 Torr, there is no significant difference in efficiency between pulse lighting and ac lighting, but at an enclosed gas pressure higher than 10 Torr, the efficiency in pulse lighting is higher than the efficiency in ac lighting. However, if the enclosed gas pressure exceeds about 70 Torr, then the efficiency of the lamp in ac lighting still rises but the efficiency of the lamp in pulse lighting begins to drop, and then at 200 to 300 Torr, the efficiency of the lamp in pulse lighting approaches the value of the efficiency in ac lighting again. On the other hand, FIG. 3 shows a relationship between an enclosed gas pressure and a starting voltage. It can be seen from this figure that, as the enclosed gas pressure increases, a progressively high voltage becomes necessary for starting. Since such rise of the starting voltage is remarkable particularly at an enclosed gas pressure higher than 200 Torr, preferably the enclosed gas pressure is lower than 200 Torr. Accordingly, from FIGS. 2 and 3, the optimum enclosed gas pressure at which the efficiency is higher than that in high frequency lighting and pulse lighting wherein the starting voltage is practical can be attained is higher than 10 Torr but lower than 200 Torr.

Figure 4:
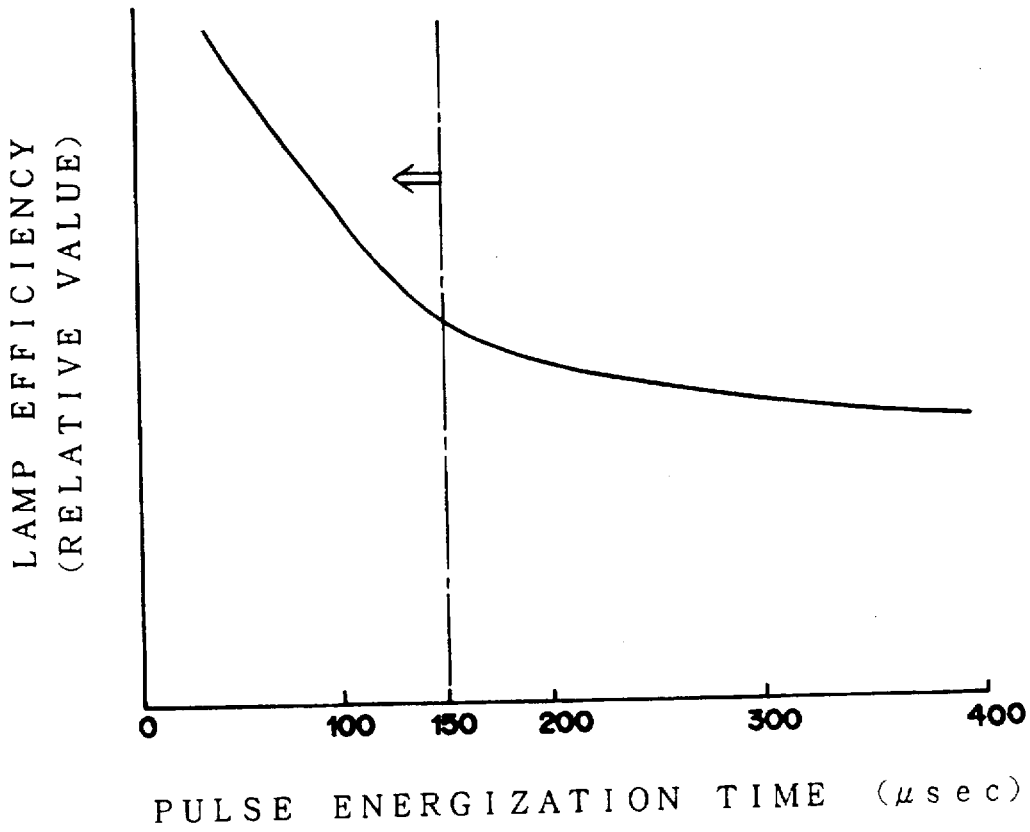
Figure 5:
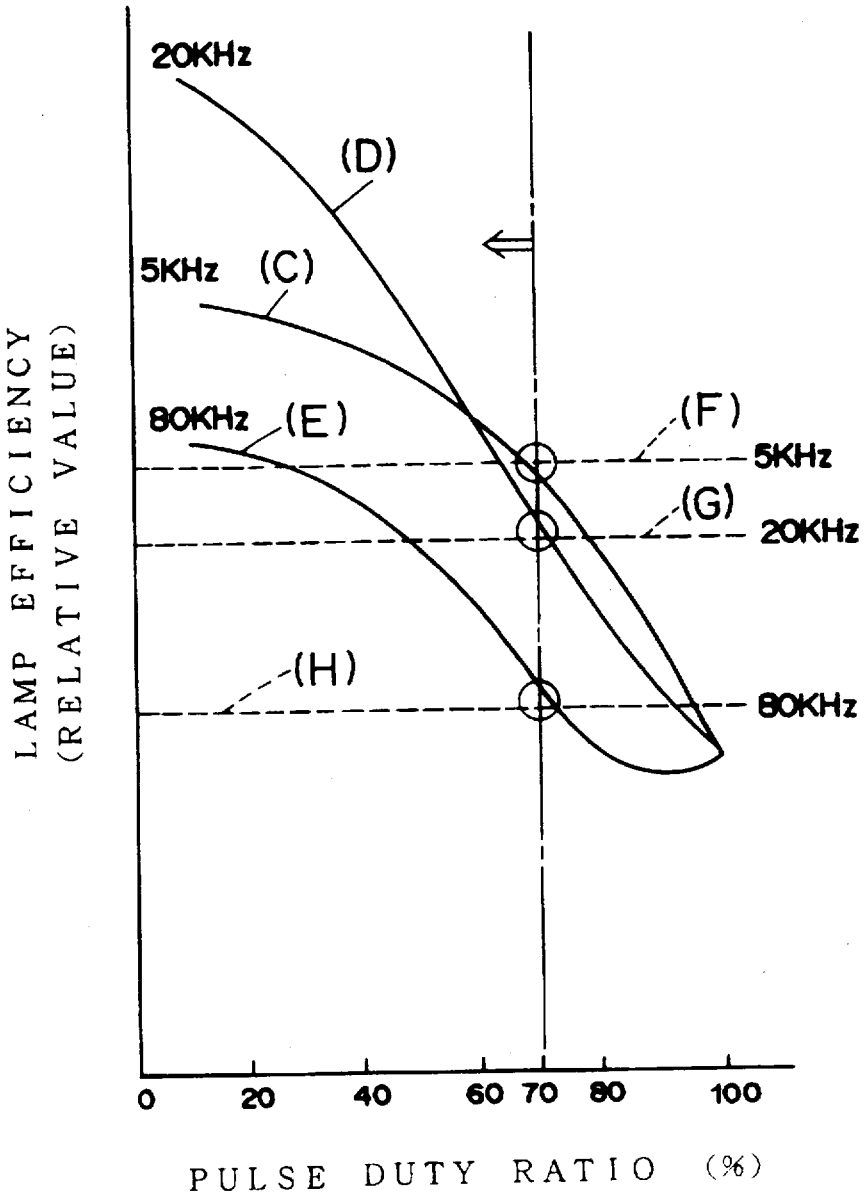

On the other hand, several lamps having diameters ranging from 8 mm to 15.5 mm and a length of 300 mm at an enclosed xenon gas pressure of 30 Torr were produced, and characteristics of the lamps were measured changing the dc pulse lighting conditions variously. Results of such measurement are shown in FIGS. 4 and 5. FIG. 4 shows a relationship between an energization time within a period of a dc pulse and a lamp efficiency while the idle time is held fixed to 100 μsec. From this figure, it can be seen that the shorter the pulse energization time, the higher the efficiency, and the effect is particularly remarkable where the pulse energization time is shorter than 150 μsec. FIG. 5 shows relationship between a lamp efficiency and a pulse duty ratio in the case of pulse lighting at frequencies of 5 KHz to 80 KHz ("C", "D" and "E").

Further, efficiency values in high frequency ac lighting (sine wave) at frequencies of 5 KHz to 80 KHz which are used commonly are shown as comparison values ("F", "G" and "H"). From FIG. 5, it can be seen that the efficiency is raised significantly by decreasing the duty ratio of pulses as compared with that in dc lighting (duty ratio=100%), and even compared with that in ac lighting at the same frequency, the efficiency is much higher if the pulse duty ratio is made lower than 70%.

Figure 6:
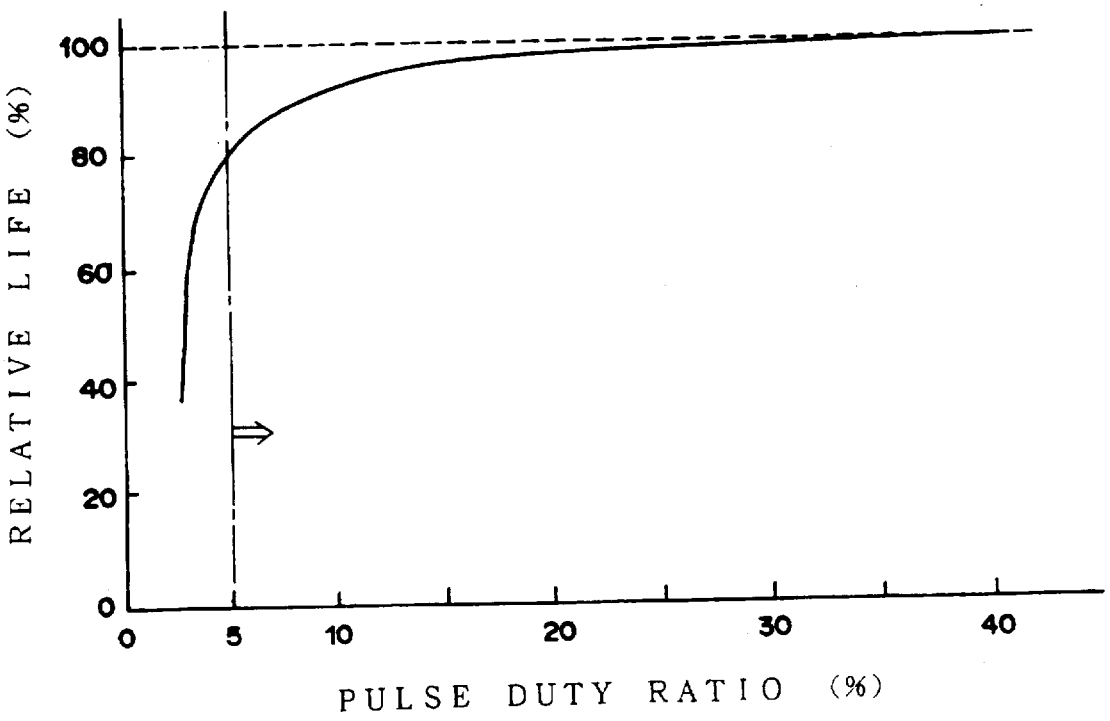
Figure 7:
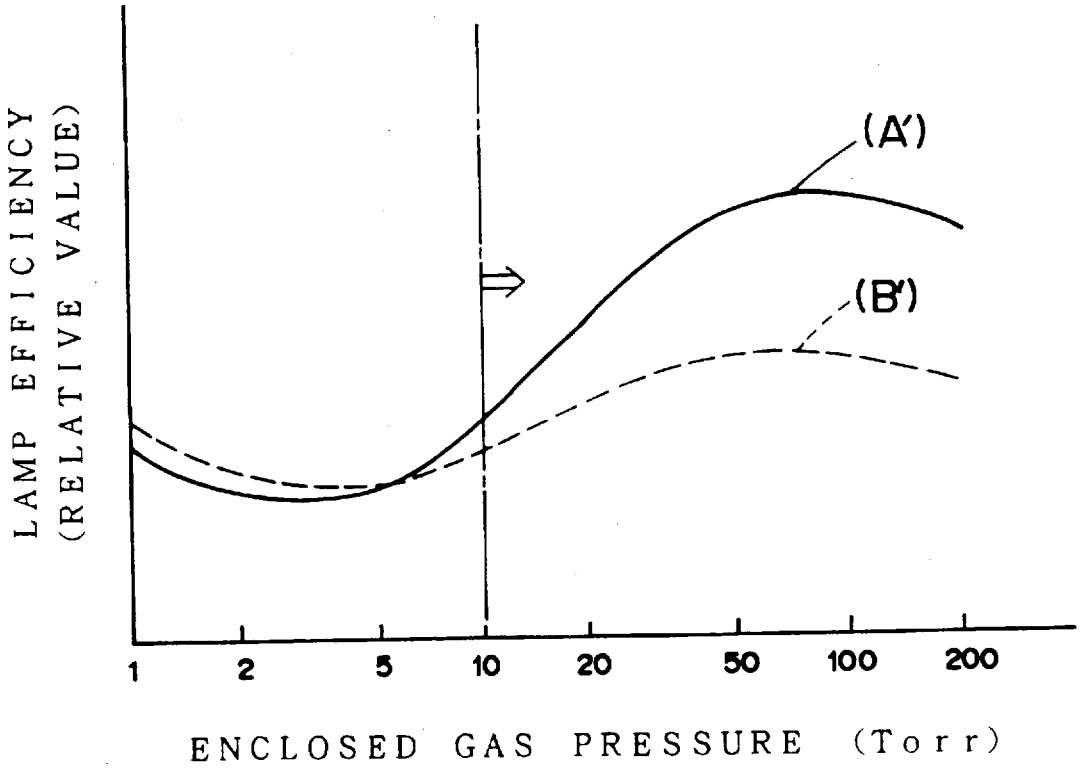
Figure 8:
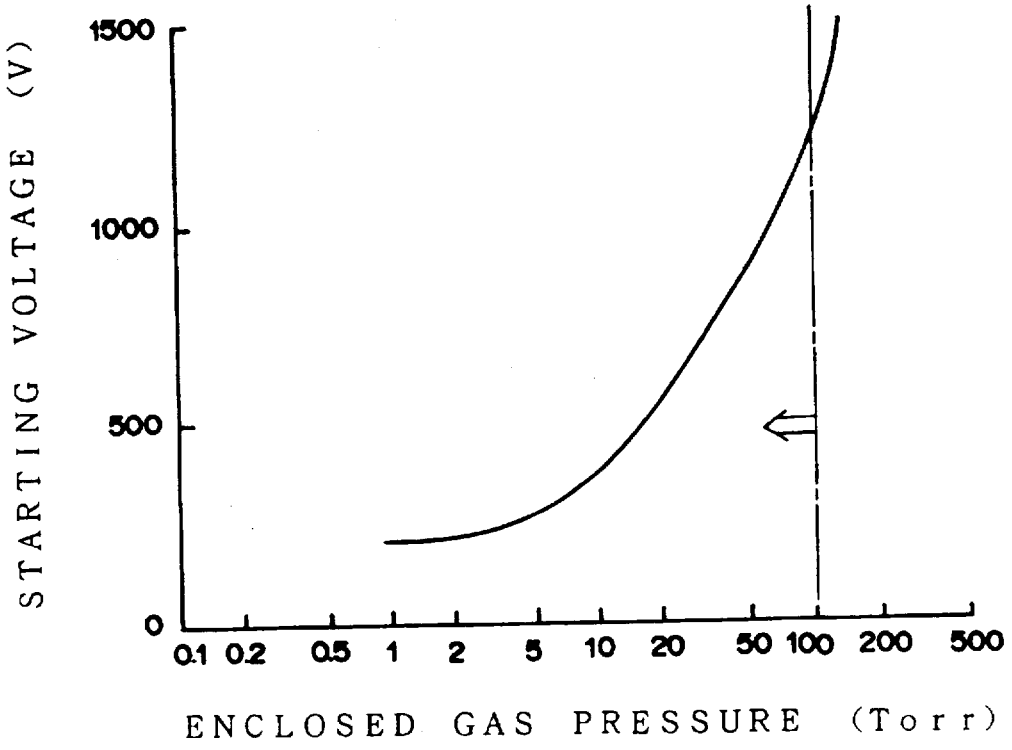
Figure 9:
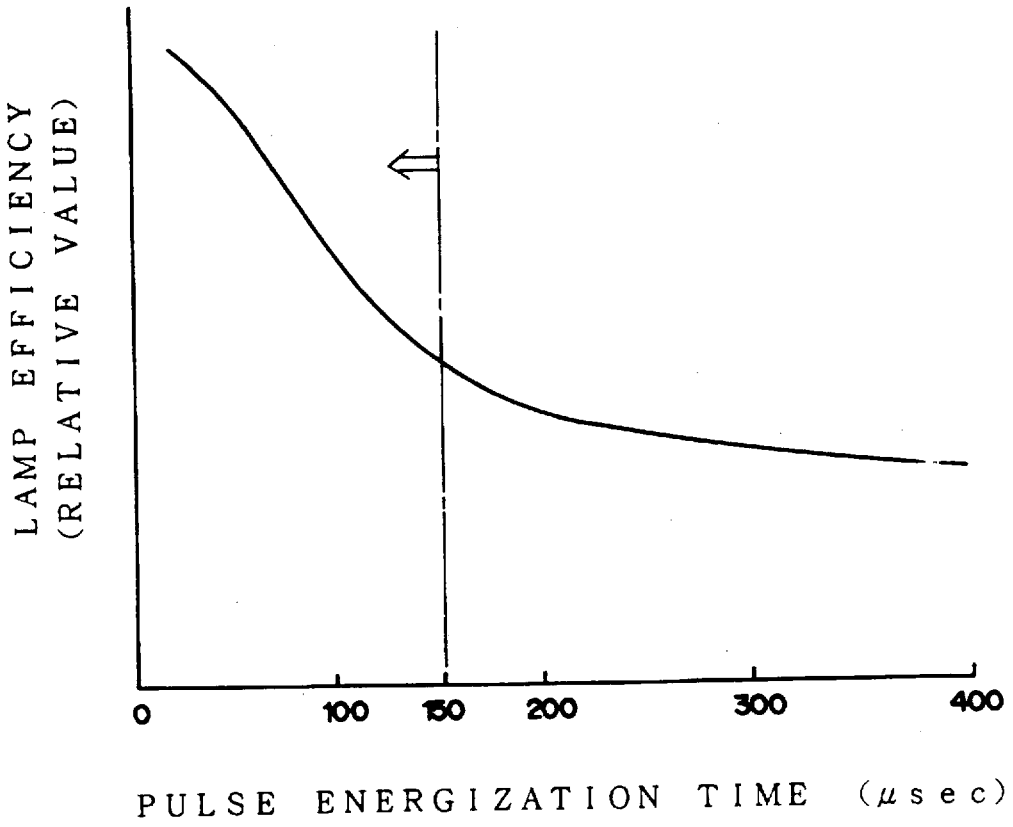
Figure 10:
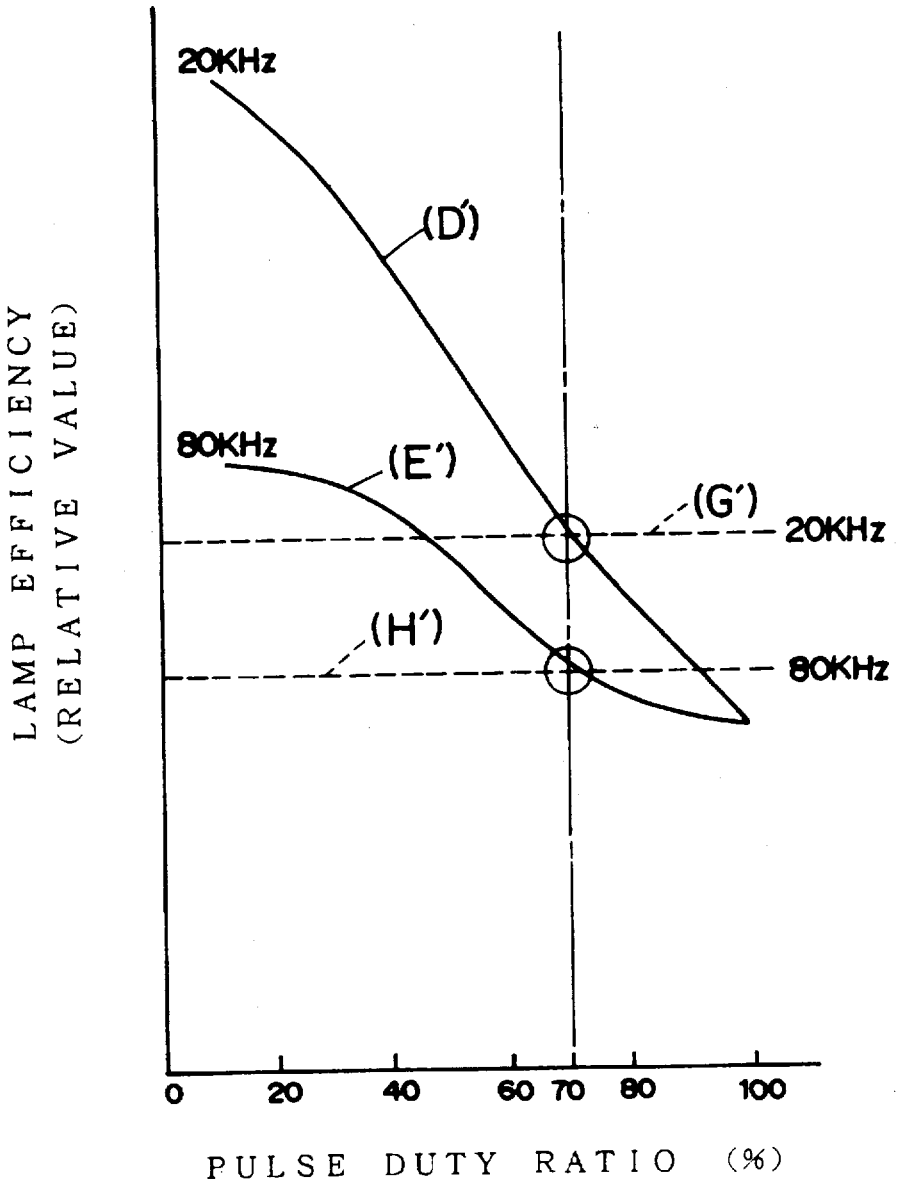
Figure 11:
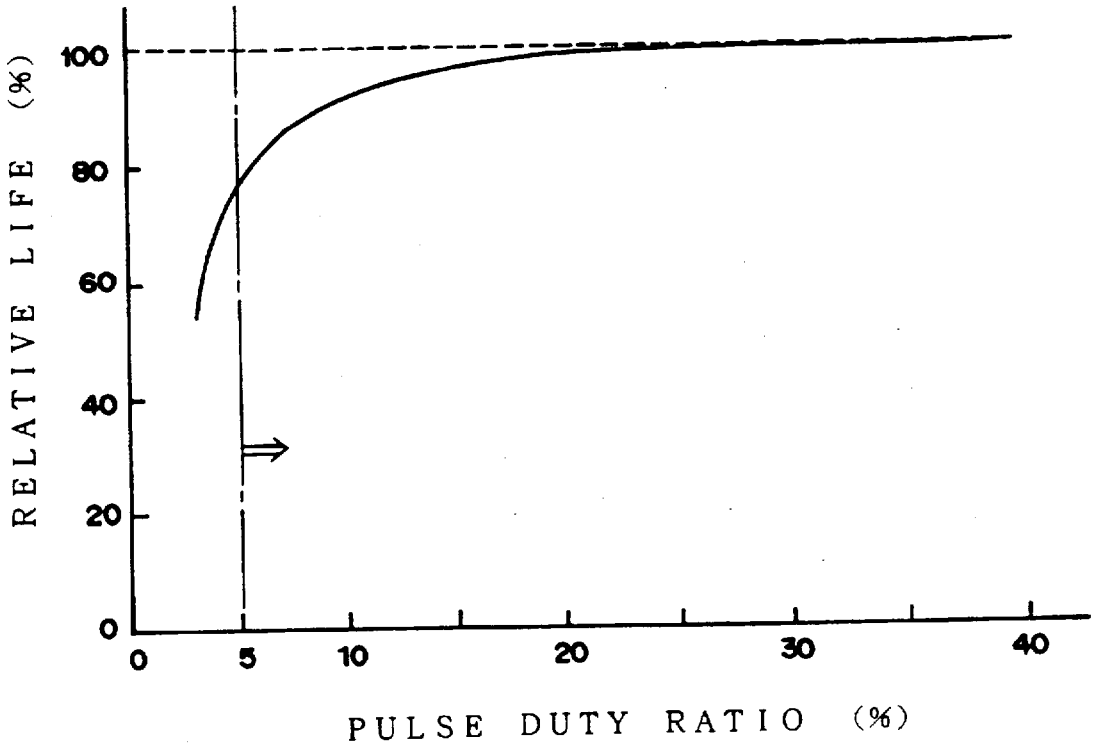

Further, several lamps having diameter ranging from 8 mm to 15.5 mm at enclosed xenon gas pressure of 10 Torr to 200 Torr were produced, and a life test of the lamps was conducted changing the pulse duty ratio while keeping the lamp power fixed. Results are shown in FIG. 6. Here, the terminology "relative life" signifies a ratio of an average life time when the lamp is lit at a varying duty ratio to an average life time when the lamp is lit at a predetermined fixed duty ratio (for example, 40%). From FIG. 6, it can be seen that the relationship between a pulse duty ratio and a relative life presents such a variation that, if the pulse duty ratio is reduced until it comes down to 5%, the relative life exhibits a little decreasing tendency, and after the pulse duty ratio is reduced beyond 5%, the life drops suddenly. It is presumed that, where the duty ratio is lower than 5%, the pulse peak current of the lamp increases so significantly that wear of the electrodes progresses suddenly. Accordingly, the pulse duty ratio is preferably higher than 5% when the life is taken into consideration.

FIGS. 7 to 11 are characteristic views showing the result of a similar examination of the above case, wherein krypton gas is enclosed in the lamp instead of the above xenon gas and from the results of these examinations, it can be seen that the optimum enclosed krypton gas pressure is more than 10 Torr but less than 100 Torr, the energization time to a period is less than 150 μsec, and the pulse duty ratio is preferably higher than 5%, but lower than 70%.

Figure 12:
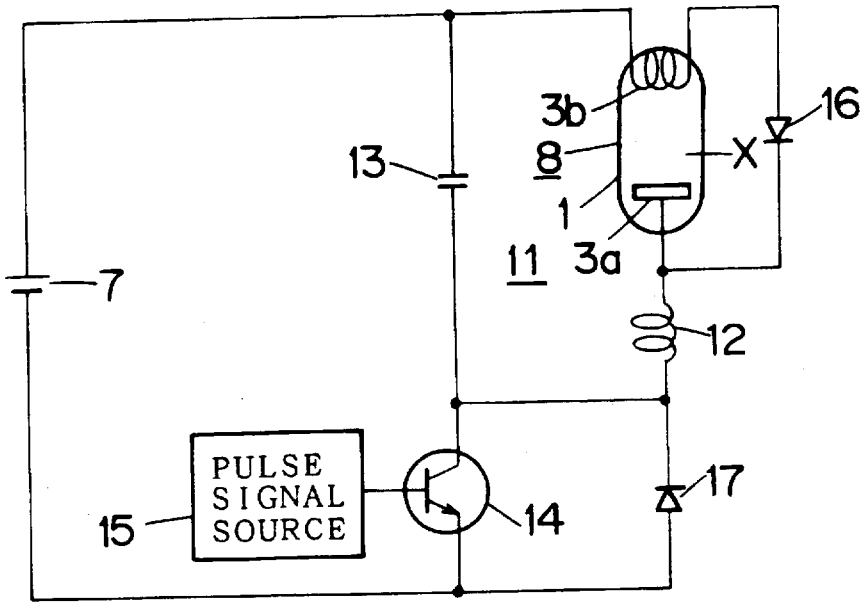
Figure 13:
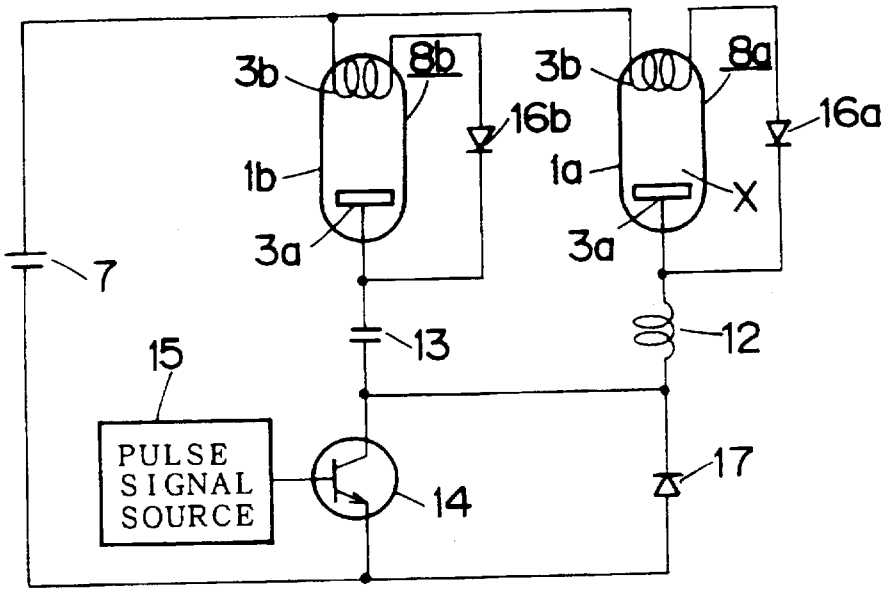

By the way, in the above embodiment, the inductance 12 is disposed nearer to dc power source 7 than the lamp 8 is, if the lamp 8 is disposed nearer to the dc power source 7 than the inductance 12 is, as shown in FIG. 12, noise can be reduced, and further, if in addition to a lamp 8*a* which corresponds to the lamp 8 of FIG. 12, another lamp 8*b* is additionally provided in the condenser side as shown in FIG. 13, the device can be converted to a multi-lighting device.

[Other Embodiments]

Figure 14:
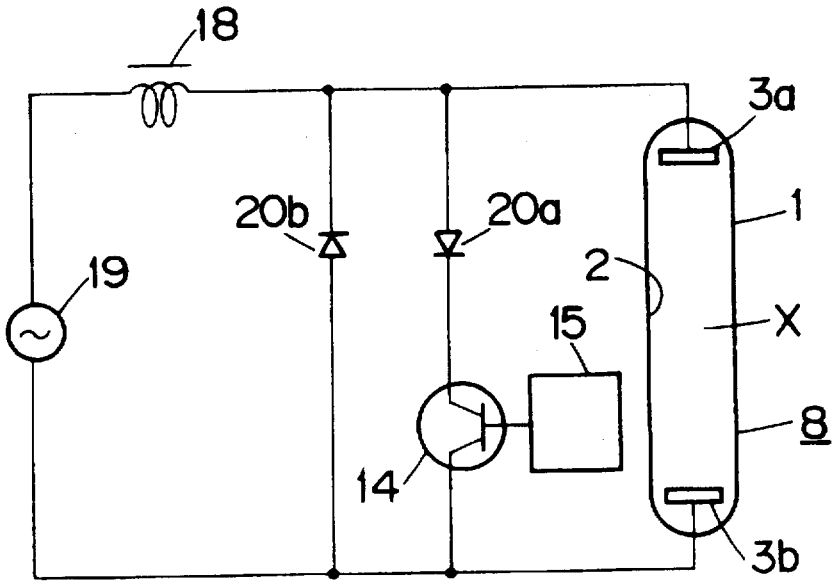
FIGS. 14 to 19 are drawings corresponding to a rare gas discharge fluorescent lamp device according to another embodiment of the present invention.

In the following, rare gas discharge fluorescent lamp devices according to other embodiments of the present invention are described with reference to the drawings. FIG. 14 indicates a block diagram showing another embodiment according to the present invention, in which like reference characters denote like or corresponding portions of the preceding figures.

In the figure, reference numeral 1 is a glass bulb which has a fluorescent layer 2 formed on an inner surface thereof, and rare gas X is enclosed therein. Reference numerals 3*a*, 3*b* denote electrodes respectively disposed at opposite ends of the bulb, which electrodes composing a rare gas discharge fluorescent lamp 8 (hereinafter referred to as a lamp) together with the above bulb 1. Reference numeral 18 denotes a current limiting element, one end of which is connected to the electrode 3*a*, and it can be a condenser, if not an inductance as used in this embodiment. Reference numeral 19 denotes a high frequency power source, and is connected to the current limiting element 18 and to the other electrode 3*b* of the lamp 8. Numerals 20*a* and 20*b* are both diodes, and 14 denotes a switching element, wherein the diode 20*a* is serially connected to the switching element 14, and this circuit is connected to the lamp 8 in parallel, as is so connected the diode 20*b* whose polarity is opposite to that of the diode 20*a*. Reference numeral 15 denotes a control means for controlling the open and closed states of the above switching element 14 by feeding pulse signals to a control electrode (base electrode) of the switching element 14. The control means 15 controls the switching element 14 to set the open state thereof to a half period of the wave form of the high frequency power source 19, and the closed state thereof to odd-number times as long as the half period, by synchronizing with the high frequency power source 19. The above switching element 14, the control means 15, the current limiting element 18, and diodes 20*a* and 20*b* compose an electric voltage generating means altogether.

Figure 15:
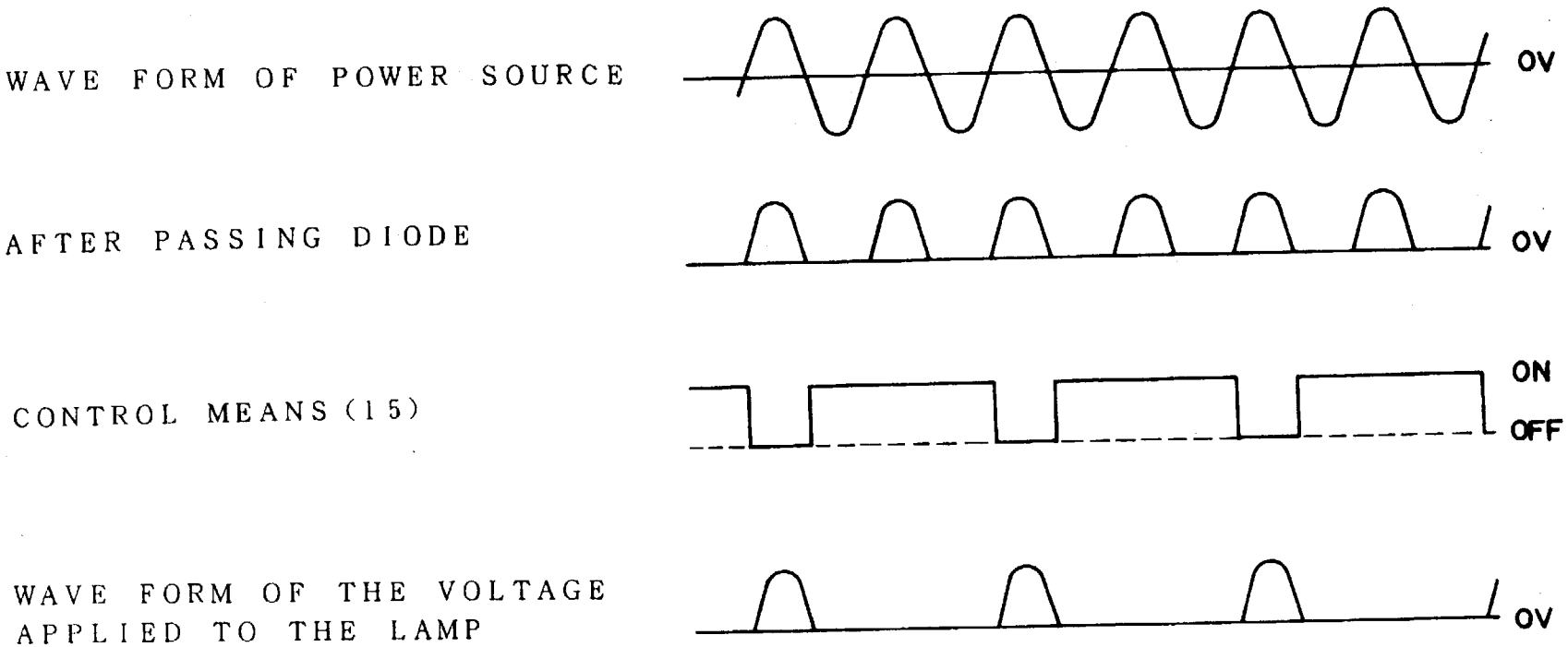

An operation of the Fare gas discharge fluorescent lamp device as constructed above is explained below. FIG. 15 indicates a relationship among the high-frequency power source 19, the control means 15, and an output of the voltage applied to the lamp, wherein the closed state of the switching element is three times as long as the half period of the wave form of the power source. First of all, since the diode 20*b* is connected to the lamp 8 in parallel, the wave form from the power source is basically a rectified half wave. Then, the control means synchronizing with the frequency of the high frequency power source 19, applies pulse signals to the switching element 14 to control the open and closed states thereof such that off state of the pulse signal is half to a period of the wave form from the power source, and the on state is odd-number times as long as the half period. In the case that the switching element 14 is closed by a pulse signal, since this circuit becomes equivalent to the one in which two diodes 20*a*, 20*b*, whose polarities are respectively opposite to each other, are connected to the lamp 8 in parallel, the electric current flows into the diodes, and the voltage is not applied to the lamp 8. On the other hand, when the switching element 14 is opened, an electric current does not flow into the diode 20*b* in the case that an electric voltage is applied thereto in the opposite direction, so that the voltage is applied to the lamp 8. However, since the open state is only for half period of the current applied from the power source, the voltage applied to the lamp is only for this half period. Repetition of the open and closed states of the switching element 14 generates a pulse-like voltage such that an energization time is equal to a half period of the wave form from the power source, and an idle time is odd-number times as long as the half period of the wave form from the power source, and during the energization time, a glow discharge takes place between a pair of electrodes 3*a* and 3*b*, and this glow discharge excites rare gas X enclosed in the bulb 1 so that the rare gas emits peculiar ultraviolet rays therefrom. The ultraviolet rays excite the fluorescent layer 2 formed on the inner face of the bulb 1, and consequently visible rays of light are emitted and discharged to the outside of the bulb 1.

Figure 16:
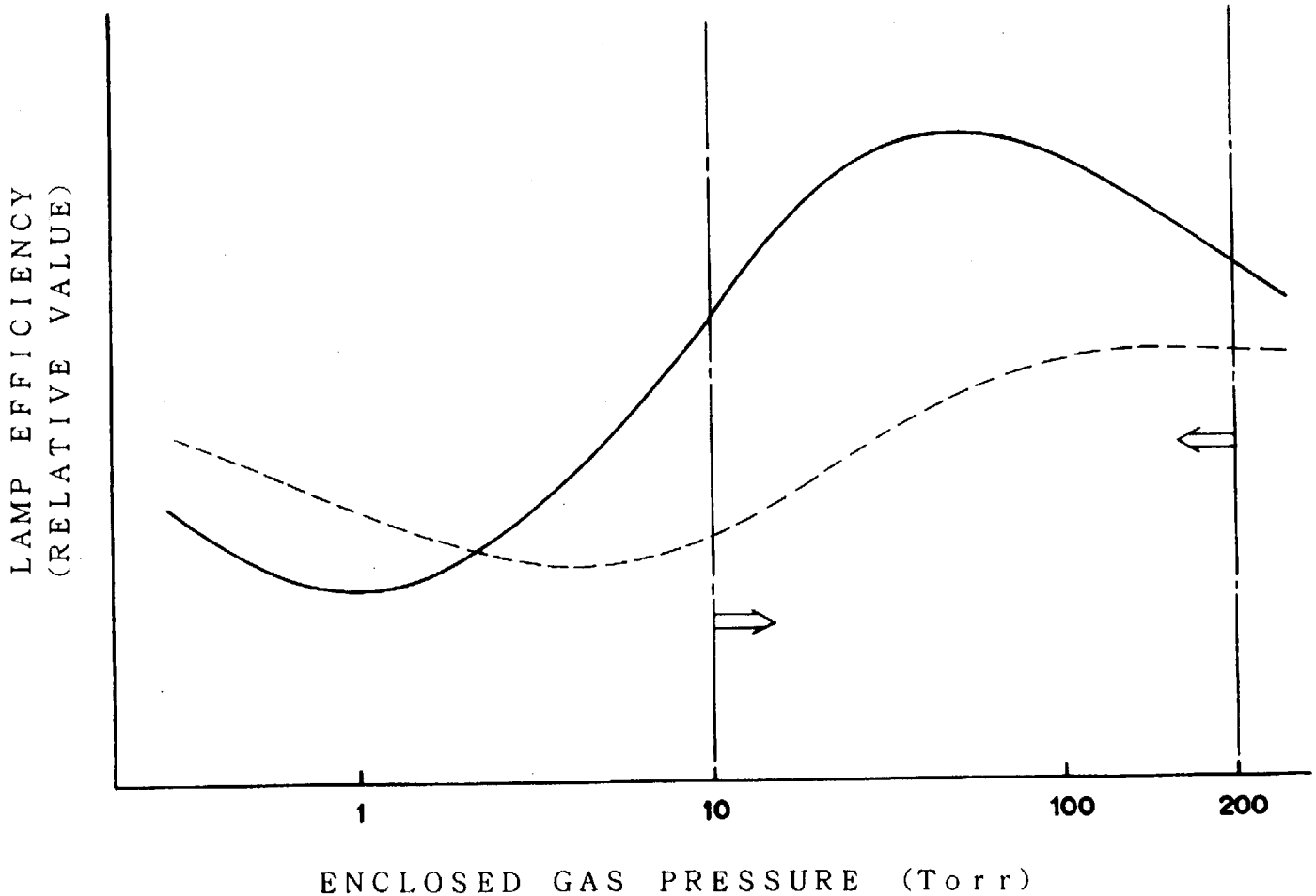

A relationship between the lighting condition and characteristic of the lamp concerning the rare gas discharge fluorescent lamp constructed as above is examined. FIG. 16 shows a relationship between an enclosed rare gas pressure and a lamp efficiency. The lamp used has an outer diameter of 10 mm and an axial length of 300 mm and the gas enclosed therein is xenon gas and frequency is 50 KHz, and power of the lamp is constant at 5 W. In FIG. 16, a solid curve line indicates the occasion that the idle time is three times as long as the half period of the wave form applied from the power current of the case of FIG. 15, and a broken line indicates the case of high frequency lighting based on an ordinary ac sine wave. It can be seen from FIG. 16 that the lamp device of the embodiment of the present invention shown in FIG. 15 presents an effect of improvement in lamp efficiency and such effect of improvement in lamp efficiency depending upon a pressure of enclosed gas. Also, it can be seen from FIG. 16 that a maximum efficiency is obtained where the enclosed xenon gas pressure is within a region of several tens Torr and that the significant effect of improvement in efficiency by the present invention as compared with that in ordinary high frequency lighting can be obtained within a range of the enclosed xenon gas pressure between 10 Torr to 200 Torr. Such improvement in lamp efficiency arises from the fact that pulse-like discharge wherein an energization time and an idle time alternatively appear modulates electron energy of a positive column to a high degree to increase the energy to excite the xenon gas so as to increase ultraviolet rays to be generated from the xenon gas, and also from emission of after glow light during such idle time. For example, the value of 10 Torr at which the lamp efficiency presents significant improvement corresponds to a pressure at which emission of after glow light during such idle time, which hardly appears at several Torr, appears significantly. By the way, the improvement in efficiency is comparatively low at a high pressure, but this phenomenon arises from the fact that, if the pressure is excessively high, then the electron energy is restrained by frequent collisions of electrons with xenon gas, and consequently, the electron energy is not modulated readily by pulses.

Figure 17:
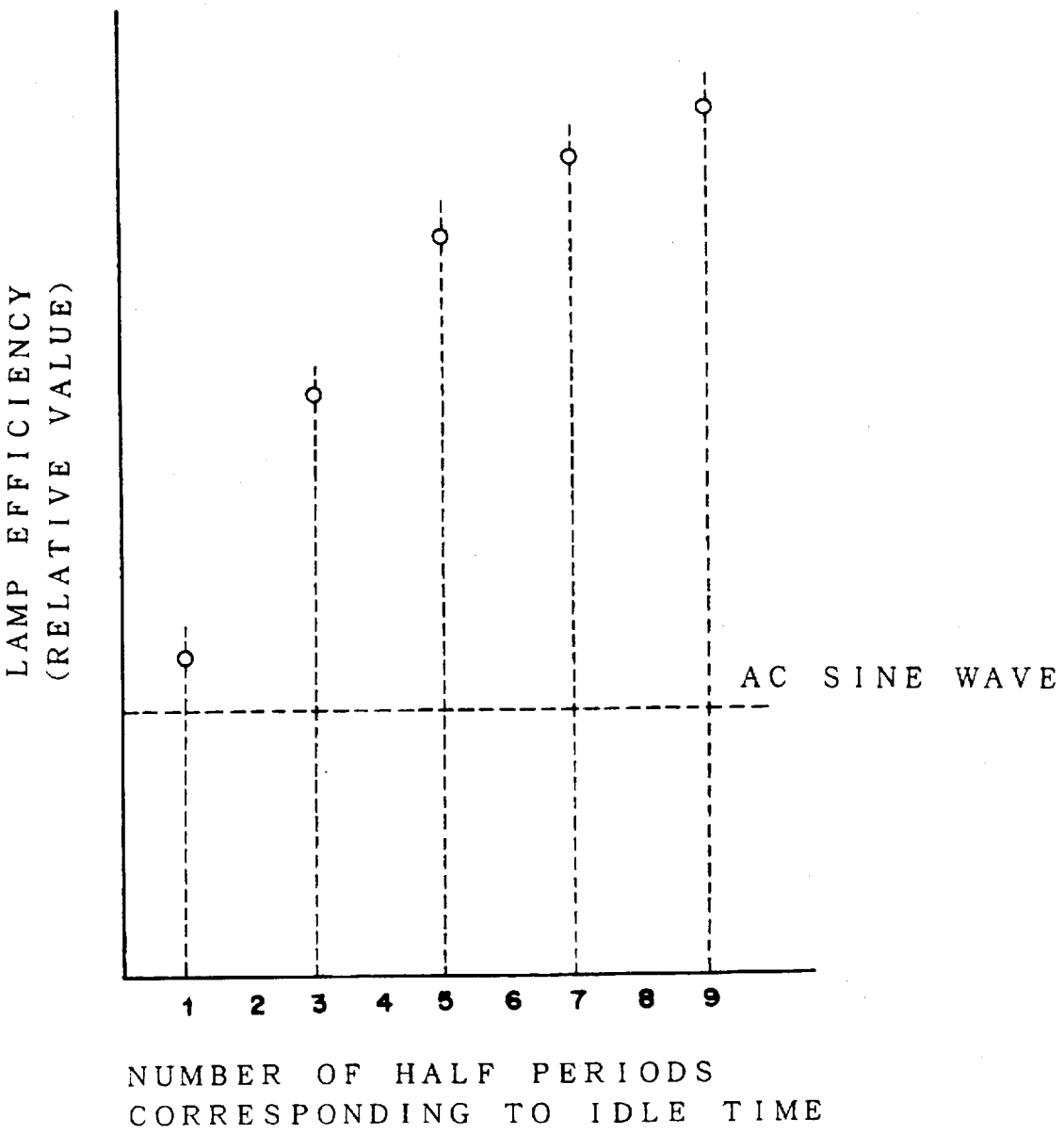

FIG. 17 shows variation of the lamp efficiency in accordance with the variation of the idle time at the fixed electric frequency at 50 KHz. The lamp used here is same as that of FIG. 18 with 30 Torr pressure of the gas enclosed therein, and the lamp power is fixed to 5 W. From FIG. 17, it can be seen that lamp efficiency can be improved if the lamp is lit in such a condition that idle time thereof is longer than a half to a period of the ac frequency.

Figure 18:
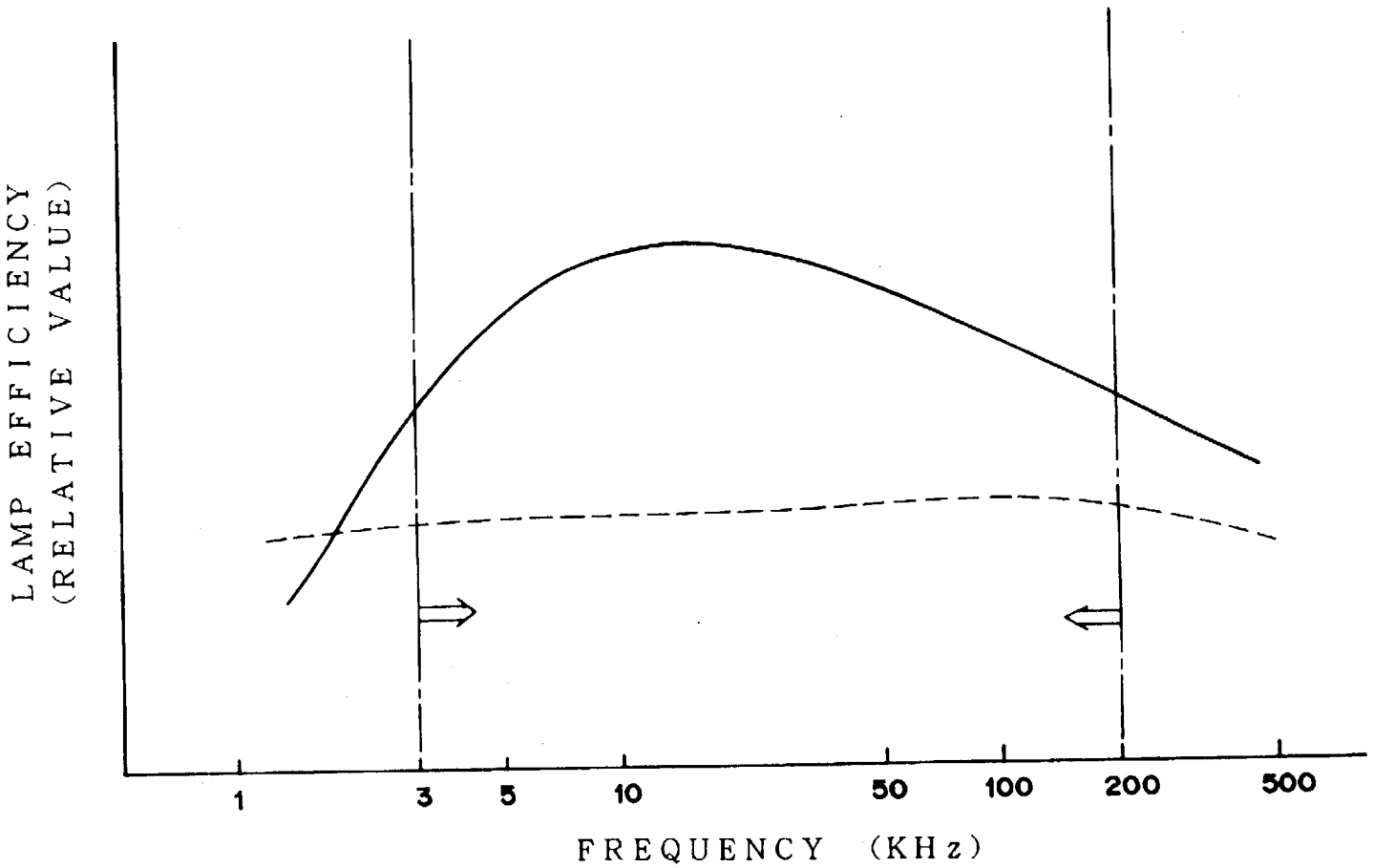

FIG. 18 shows variation of lamp efficiency in accordance with the variation of the ac frequency at the fixed idle time which is three times as long as a half period of the ac wave form. The lamp used here is same as that of FIG. 16 with 30 Torr pressure of the gas enclosed therein, and the lamp power is fixed at 5 W. The solid curve line indicates the case of the embodiment shown in FIG. 14, and a broken line indicates the case of high frequency lighting based on an ordinary ac sine wave.

From FIG. 18, it can be seen that a high efficiency is obtained at a frequency higher than 3 KHz with the rare gas discharge fluorescent lamp device of the embodiment of the present invention shown in FIG. 14 as compared with that in ordinary high frequency lighting. It can also be seen that, if the frequency rises to about 200 KHz, the efficiencies in the two cases present substantially same levels. Accordingly, the frequency should be higher than 3 KHz but lower than 200 KHz.

It is to be noted that the reason why the efficiency drops at high frequency and becomes substantially equal to that in the case of ordinary high frequency lighting is that a plasma parameter of a positive column cannot follow such high frequency and gradually approaches a fixed condition similar to a dc current.

As above, since the rare gas discharge fluorescent lamp device constructed as shown in FIG. 14 applies pulse-like voltage having idle time to the lamp, brightness and lighting efficiency of the lamp can be greatly improved.

By the way, although xenon gas is enclosed in the above embodiment, rare gas other than xenon gas can be enclosed either individually or together with xenon gas to gain the same improvement in efficiency as above. Further, although a lamp having outer diameter of 10 mm is adopted in the above embodiment, various other lamps having other diameters within the range of 8 to 15.5 mm were also examined and same high efficiency was obtained as the result.

Figure 19:
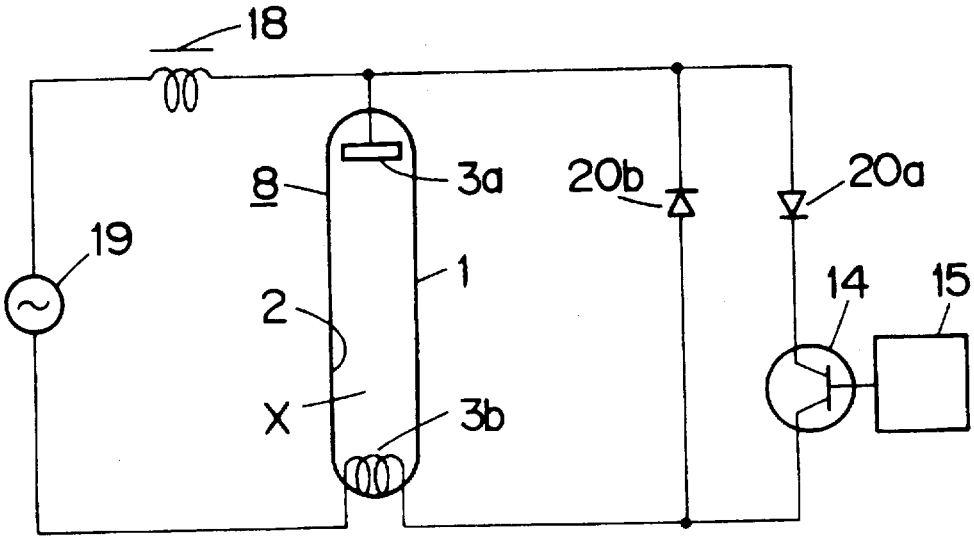

FIG. 19 is a block diagram indicating another embodiment of the present invention, wherein a lamp of a hot cathode electrode type is shown. In the figure, reference numeral 1 is a glass bulb which has a fluorescent layer 2 formed on an inner surface thereof, and rare gas X is enclosed therein. Reference numeral 3*a* denotes an anode provided at one end of the bulb, and 3*b* denotes a cathode filament at the other end of the bulb, the both electrodes composing a rare gas discharge fluorescent lamp 8 (hereinafter referred to as a lamp) together with the above bulb 1. Reference numeral 18 denotes a current limiting element connected to the anode 3*a*, and it can be a condenser, if not an inductance as used in this embodiment. Reference numeral 19 denotes a high frequency power source, and is connected to the current limiting element 18 and to one end of the cathode filament 3*b* of the rare gas discharge fluorescent lamp 8. Numerals 20*a* and 20*b* are both diodes and 14 denotes a switching element, wherein the diode 20*b* is connected to the anode 3*a* and also to the other end of the cathode filament 3*b* having its cathode side heading for the anode side of the lamp, whereas the diode 20*a* is serially connected to the switching element 14, and this circuit is connected to the anode 3*a* and to the other end of the cathode filament 3*b* of the lamp 8 in parallel, as is so connected the diode 20*b* whose polarity is opposite to that of the diode 20*a*. Reference numeral denotes a control means for controlling the open and closed states of the above switching element 14 by feeding pulse signals to a control electrode (base electrode) of the switching element 14. The control means 15 controls the switching element 14 to set the open state thereof to a half period of the wave form of the high frequency power source 19, and the closed state thereof to odd-number times as long as the half period, by synchronizing with the high frequency power source 19.

The rare gas discharge fluorescent lamp device of hot cathode type as constructed above could also obtain same improvement in efficiency as the case of FIG. 14. Further, in the case of the embodiment as shown in FIG. 19, the electric current flows into the diode through the filament of the cathode side of the lamp during the idle time of the applied voltage, and preheating function is thus also provided. Accordingly, the above embodiment of FIG. 19 can improve brightness and lighting efficiency of the lamp, and obviates any additional circuit to preheat the electrode, thereby making it possible to simplify the circuit as a whole.

[Further Embodiments]

In the following, rare gas discharge fluorescent lamp devices according to further embodiments of the present invention are described with reference to the drawings.

Figure 20:
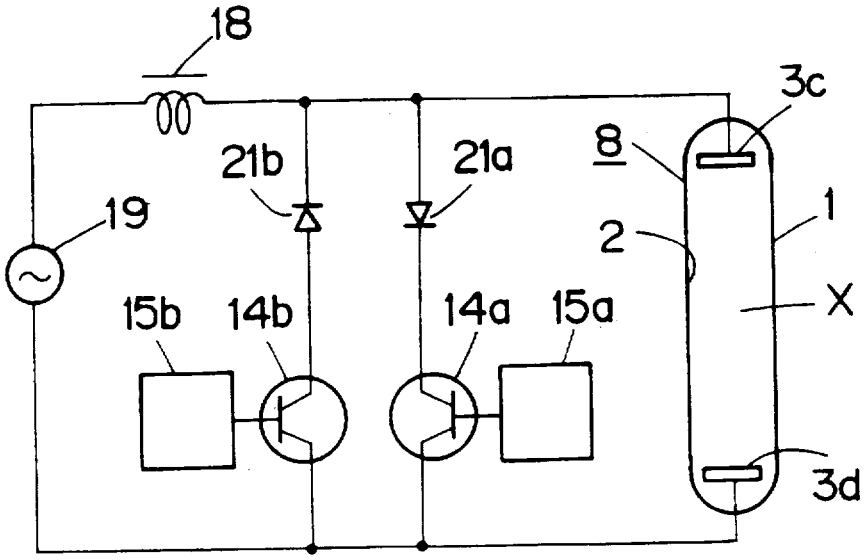
FIGS. 20 to 25 are drawings corresponding to a rare gas discharge fluorescent lamp device according to further embodiment of the present, invention.

FIG. 20 is a block diagram showing further embodiment according to the present invention. In the figure, reference numeral 1 is a glass bulb which has a fluorescent layer 2 formed on an inner surface thereof, and rare gas X is enclosed therein. Reference numerals 3*a* and 3*b* denote electrodes respectively disposed at opposite ends of the bulb 1, which electrodes composing a rare gas discharge fluorescent lamp 8 (hereinafter referred to as a lamp) together with the above bulb 1. Reference numeral 18 denotes a current limiting element, one end of which is connected to the electrode 3*c*, and it can be a condenser, if not an inductance as used in this embodiment. Reference numeral 19 denotes a high frequency power source, and is connected to the current limiting element 18 and to the other electrode 3*d* of the lamp 8. Numerals 21*a* and 21*b* are both diodes, and 14*a*, 14*b* are switching elements, wherein the diodes 21*a* and 21*b* are serially connected respectively to the switching elements; 14*a* and 14*b*, with their polarities in the opposite directions from each other, and also connected to the lamp 8 respectively in parallel. Reference numerals 15*a* and 15*b* denote control means for respectively controlling the open and closed states of the above switching elements 14*a* and 14*b* by feeding pulse signals to a control electrode (base electrode) of the respective switching elements. The control means 15*a*, 15*b* control respectively the switching elements 14*a*, 14*b* to set the open states thereof to a half period of the wave form of the high frequency power source 19, and the closed states thereof to integral-number times as long as the half period, by synchronizing with the high frequency power source 19.

The above switching elements, 14*a*, 14*b*, the control means 15*a*, 15*b*, the current limiting element 18, diodes 21*a*, 21*b* compose an electric voltage generating means altogether.

Figure 21:
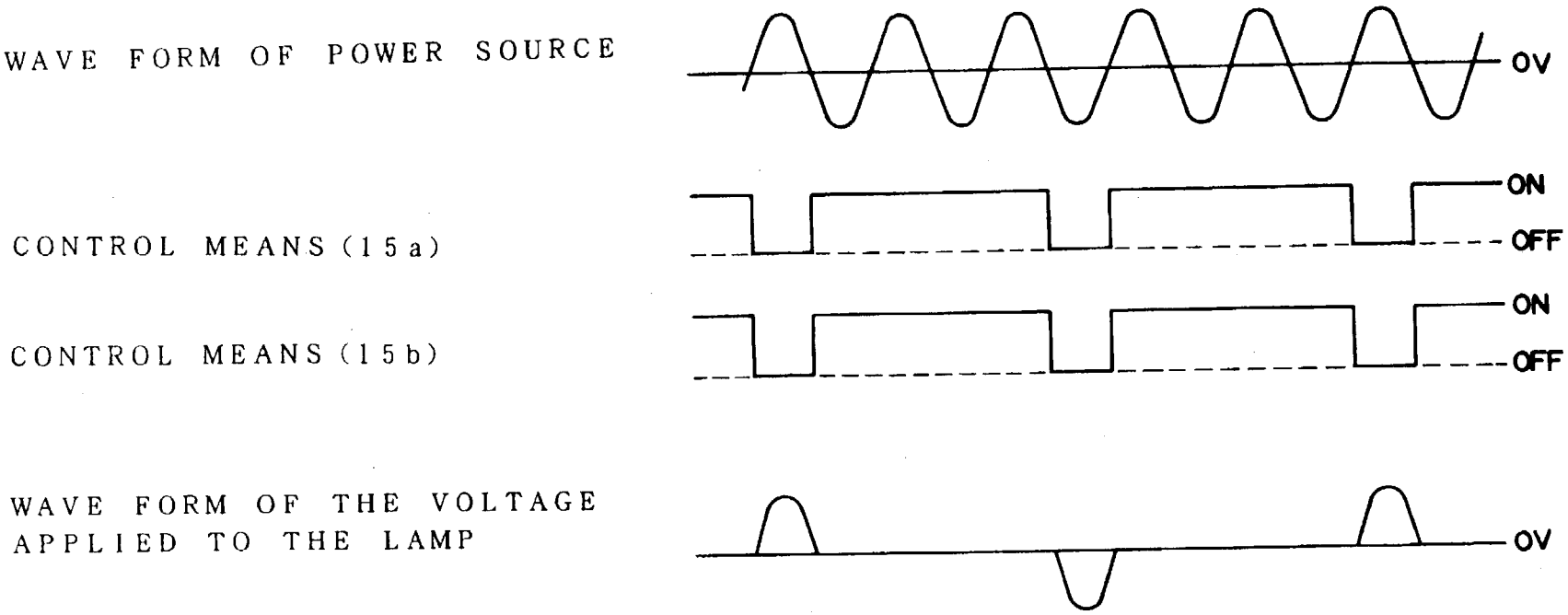

An operation of the rare gas-discharge fluorescent lamp device as constructed above is explained below. FIG. 21 indicates a relationship among the high-frequency power source 19, the control means 15*a*, 15*b*, and an output of the voltage applied to the lamp, wherein the closed state of the switching element is twice as long as the half period of the wave form of the power source. First of all, since the control means 18*a*, 15*b*, synchronizing with the frequency of the high frequency power source 19, applies pulse signals respectively to the switching elements 14*a*, 14*b* to control the open and closed states thereof such that the off state of the pulse signal is half to a period of the wave form from the power source, and the on state is integral-number times as long as the half period. In the case that the switching elements 14*a*, 14*b* are closed by pulse signals, since this circuit becomes equivalent to the state in which two diodes 21*a*, 21*b*, whose polarities are respectively opposite to each other, are connected to the lamp 8 in parallel, the electric current flows into the diodes, and the voltage is not applied to the lamp 8. On the other hand, when the switching elements 14*a*, 14*b* are in the open state, an electric current does not flow into the diodes 21*a*, 21*b*, so that the voltage is applied to the lamp 8. However, since the open state is only for half period of the current applied from the power source, the voltage applied to the lamp is only for this half period, and in addition, the polarities thereof are alternatively changing. Repetition of the open and closed states of the switching elements generates a pulse-like voltage alternatively changing its polarity such that an energization time is equal to a half of the wave form from the power source and the idle time is integral-number times as long as the half period of the wave form from the power source, and during the energization time, a glow discharge takes place between a pair of electrodes 3*c* and 3*d*, and this glow discharge excites rare gas X enclosed in the bulb 1 so that the rare gas emits peculiar ultraviolet rays therefrom. The ultraviolet rays excite the fluorescent layer 2 formed on the inner face of the bulb 1, and consequently visible rays of light are emitted and discharged to the outside of the bulb 1.

Figure 22:
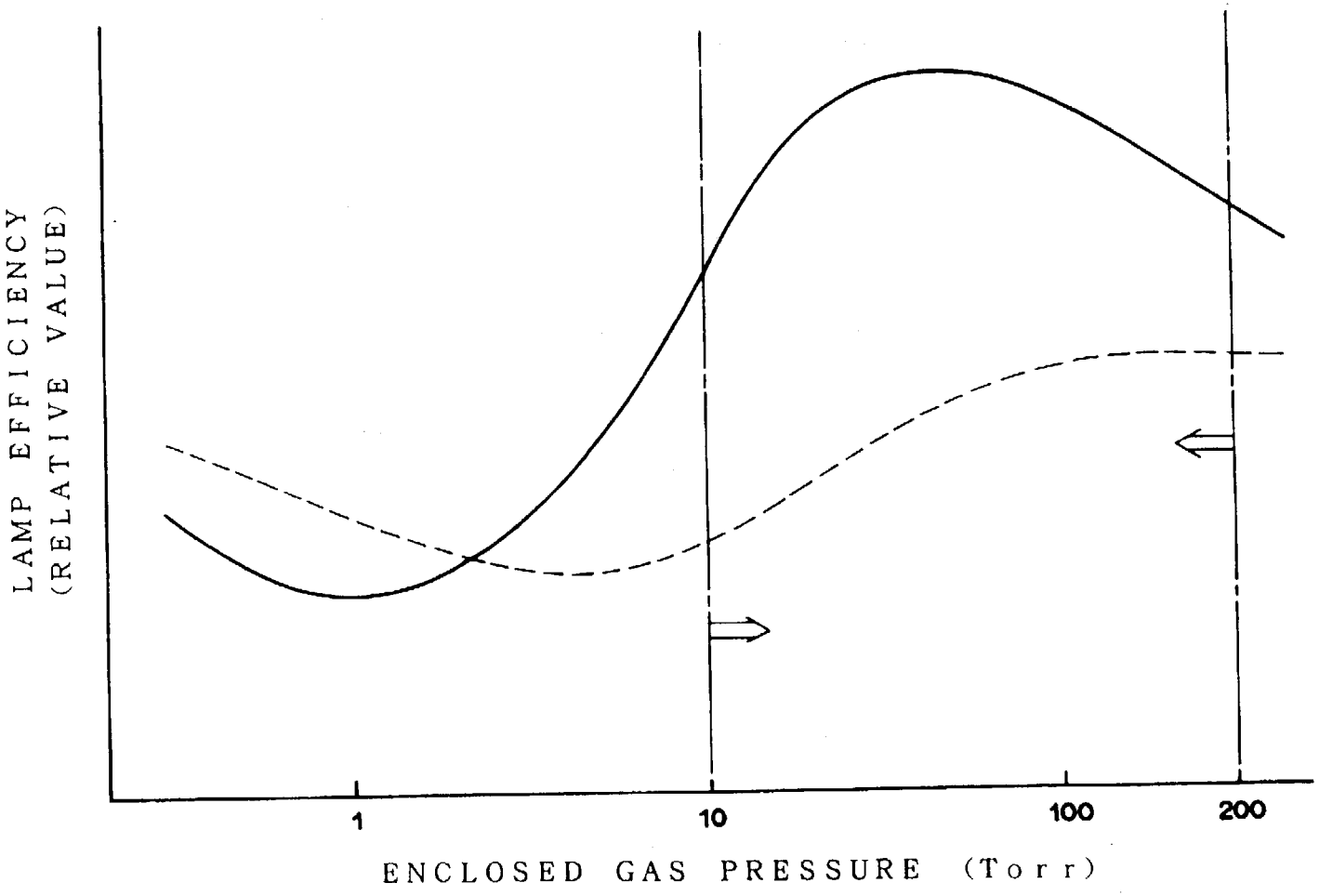

A relationship between the lighting condition and characteristic of the lamp concerning the rare gas discharge fluorescent lamp constructed as above is examined. FIG. 22 shows a relationship between an enclosed gas pressure and a lamp efficiency. The lamp used here has an outer diameter of 10 mm and an axial length of 300 mm and the gas enclosed therein is xenon gas and frequency is 50 KHz, and power of the lamp is constant at 5 W. In FIG. 22, a solid curve line indicates the occasion that the idle time is four times as long as the case of FIG. 20, and a broken line indicates the case of high frequency lighting based on an ordinary ac sine wave. It can be seen from FIG. 22 that the lamp device of the embodiment of the present invention shown in FIG. 20 presents an effect of improvement in lamp efficiency and such effect of improvement in lamp efficiency depending upon a pressure of enclosed gas. Also, it can be seen from FIG. 22 that a maximum efficiency is obtained where the enclosed xenon gas pressure is within a region of several tens Torr and that the significant effect of improvement in efficiency by the present invention as compared with that in ordinary high frequency lighting can be obtained within a range of the enclosed xenon gas pressure between 10 Torr to 200 Torr. Such improvement in lamp efficiency arises from the fact that pulse-like discharge wherein an energization time and an idle time alternatively appear modulates electron energy of a positive column to a high degree to increase the energy to excite the xenon gas so as to increase ultraviolet rays to be generated from the xenon gas, and also from emission of after glow light during such idle time. For example, the value of 10 Torr at which the lamp efficiency presents significant improvement corresponds to a pressure at which emission of after glow light during such idle time, which hardly appears at several Torr, appears significantly. By the way, the improvement in efficiency is comparatively low at a high pressure, but this phenomenon arises from the fact that, if the pressure is excessively high, then the electron energy is restrained by frequent collisions of electrons with xenon gas, and consequently, the electron energy is not modulated readily by pulses.

Figure 23:
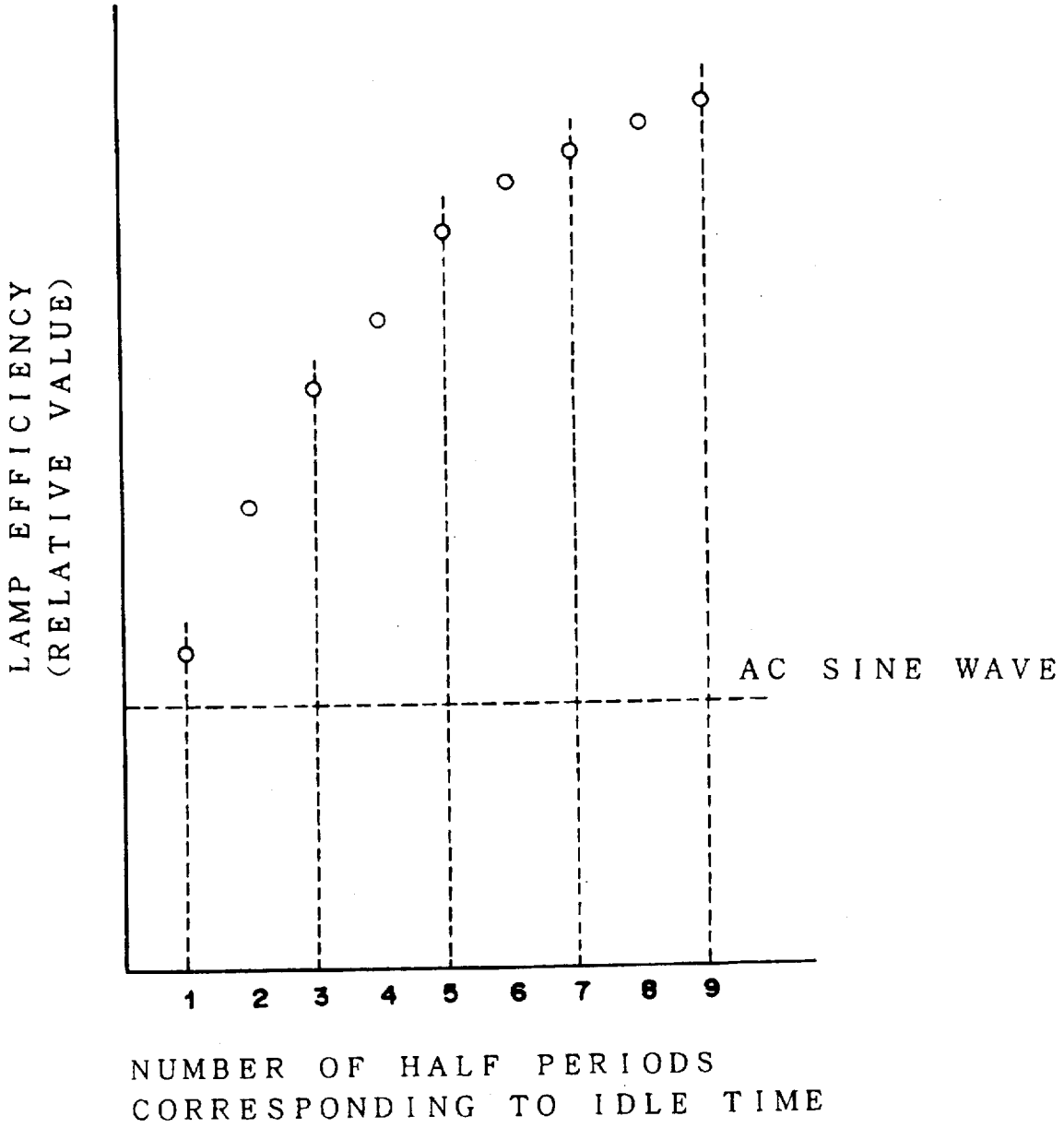

FIG. 23 shows variation of the lamp efficiency in accordance with the variation of the idle time at the fixed electric frequency at 50 KHz. The lamp used here is same as that of FIG. 22 with 30 Torr pressure of the gas enclosed therein, and the lamp power is fixed to 5 W. From FIG. 23, it can be seen that lamp efficiency can be improved if the lamp is lit in such a condition that idle time thereof is longer than a half to a period of the ac frequency.

Figure 24:
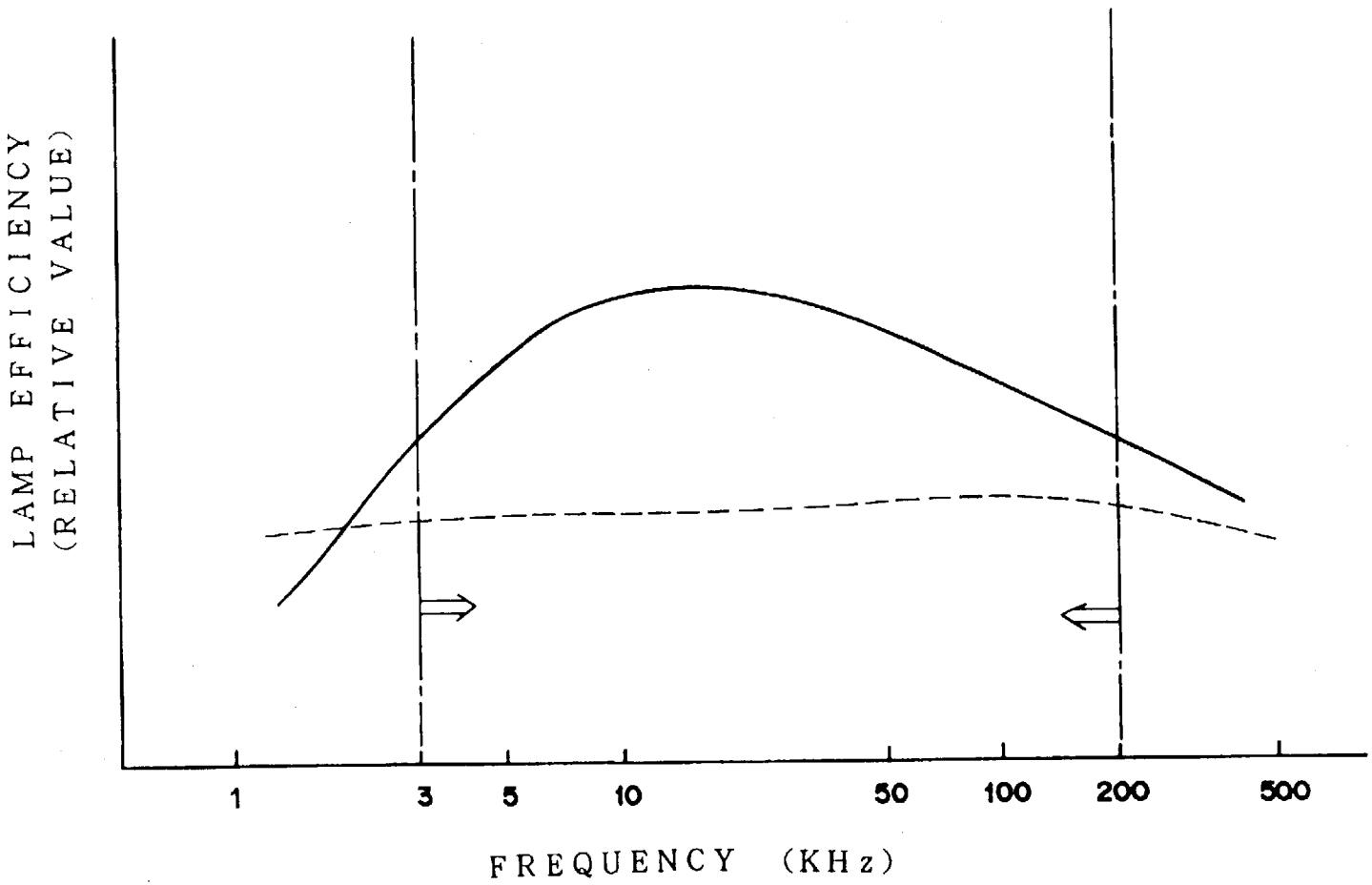

FIG. 24 shows variation of lamp efficiency in accordance with the variation of the ac frequency at the fixed idle time which is twice as long as a half period of the ac wave form. The lamp used here is same as that of FIG. 22 with 30 Torr pressure of the gas enclosed therein, and the lamp power is fixed at 5 W. The solid curve line indicates the case of the embodiment shown in FIG. 20, and a broken line indicates the case of high frequency lighting based on an ordinary ac sine wave.

From FIG. 24, it can be seen that a high efficiency is obtained at a frequency higher than 3 KHz with the rare gas discharge fluorescent lamp device of the embodiment of the present invention shown in FIG. 20 as compared with that in ordinary high frequency lighting. It can also be seen that, if the frequency rises to about 200 KHz, the efficiencies in the two cases present substantially same levels. Accordingly, the frequency should be higher than 3 KHz but lower than 200 KHz.

It is to be noted that the reason why the efficiency drops at high frequency and becomes substantially equal to that in the case of ordinary high frequency lighting is that a plasma parameter of a positive column cannot follow such high frequency and gradually approaches a fixed condition similar to a dc current.

As above, since the rare gas discharge fluorescent lamp device constructed as shown in FIG. 20 applies pulse-like voltage having idle time to the lamp, brightness and lighting efficiency of the lamp can be greatly improved.

By the way, although xenon gas is enclosed in the above embodiment, rare gas other than xenon gas can be enclosed either individually or together with xenon gas to gain the same improvement in efficiency as above. Further, although a lamp having outer diameter of 10 mm is adopted in the above embodiment, various other lamps having other diameters within the range of 8 to 15.5 mm were also examined and same high efficiency was obtained as the result.

Figure 25:
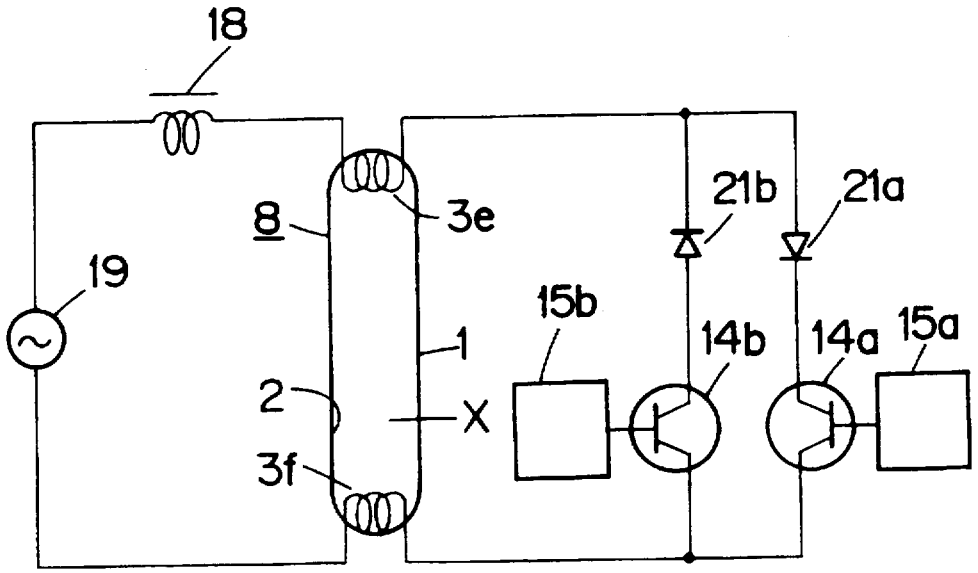
Figure 26:
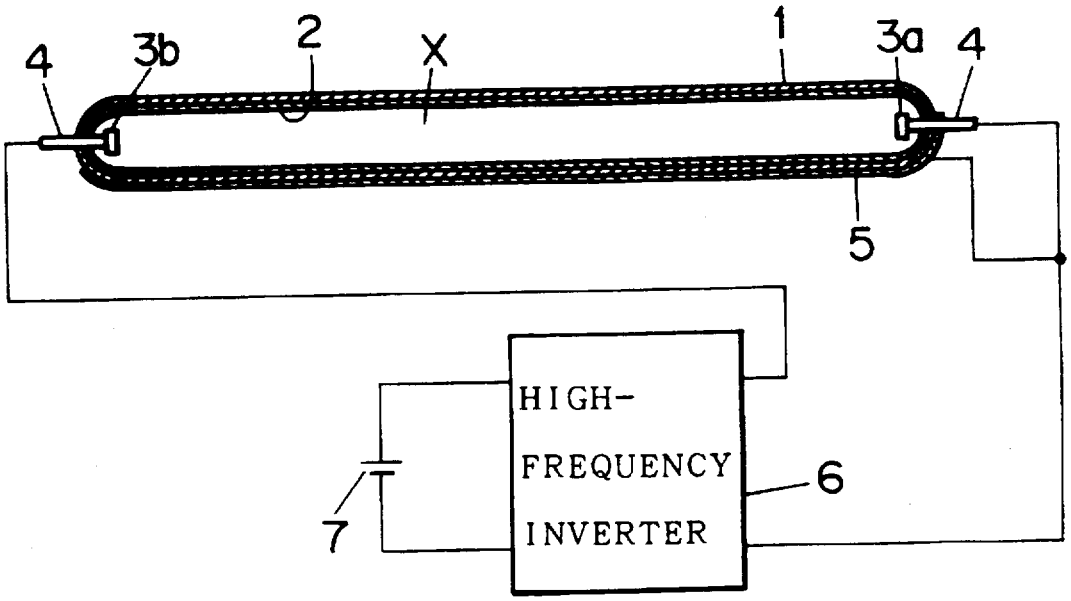
FIG. 26 is an entire constructional view of the rare gas discharge fluorescent lamp according to a conventionally known embodiment.
Figure 27:
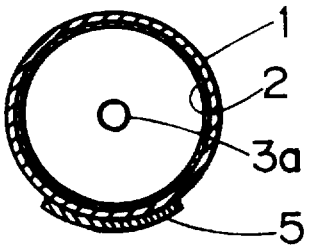
FIG. 27 is a vertical sectional view of the rare gas discharge fluorescent lamp device according to a conventionally known embodiment.

A rare gas discharge fluorescent lamp according to further embodiment of the present invention is shown in FIG. 25. In the figure, reference numeral 1 is a glass bulb which has a fluorescent layer 2 formed on an inner surface thereof, and rare gas X is enclosed therein. Reference numerals **3*e* and 3*f* denote filament electrodes respectively disposed at opposite ends of the bulb, which electrodes composing a rare gas discharge fluorescent lamp 8 together with the above bulb 1. Reference numeral 18 denotes a current limiting element, one end of which is connected to one end of a cathode filament 3*e*, and it can be a condenser, if not an inductance as used in this embodiment. Reference numeral 19 denotes a high frequency power source, and is connected to the current limiting element 18 and to the other electrode 3*f* of the lamp 8. Reference numerals 21*a* and 21*b* are both diodes, and 14*a*, 14*b* are switching elements, wherein the diodes 21*a* and 21*b* are serially connected respectively to the switching elements 14*a* and 14*b*, with their polarities contrary to each other, and also connected to the other end of the filament 3*e* of the lamp 8 respectively in parallel. Reference numerals 15*a*, 15*b* are control means for respectively controlling the open and closed states of the above switching elements 14*a*, 14*b* by feeding pulse signals to a control electrode (base electrode) of the respective switching elements. The control means 15*a*, 15*b* control respectively the switching elements to set the open states thereof to a half wave to a half period of the wave form of the high frequency power source 19, and the closed state thereof to integral-number times as long as the half period, by synchronizing with the high frequency power source 19**.

The rare gas discharge fluorescent lamp device as constructed above could also obtain the same improvement in efficiency in brightness as the case of the embodiment shown in FIG. 20. Further, in the case of the embodiment shown in FIG. 25, the electric current flows into the diode through the filament of the cathode of the lamp during the idle time of the applied voltage, and preheating function is also provided. Accordingly, the above embodiment of FIG. 25 can improve brightness and lighting efficiency of the lamp, and obviates any additional circuit to preheat the electrode, thereby making it possible to simplify the circuit as a whole.

[Effect of the Invention]

A rare gas discharge fluorescent lamp device according to one embodiment of the present invention is constructed such that it comprises a rare gas discharge fluorescent lamp wherein rare gas such as xenon gas or the like is enclosed in the inside of a glass bulb which has a fluorescent layer formed on an inner face thereof and has a pair of electrodes at the opposite ends thereof, one of which is a cathode filament, a resonance circuit which is a parallel circuit composed of a condenser and an inductance serially connected to one end of the pair of electrodes of the rare gas discharge fluorescent lamp, a series circuit comprising a direct current power source and a parallel circuit composed of a switching element connected to an anode side of the rare gas discharge fluorescent lamp and a diode, a diode provided between the other end of the cathode filament and the anode of the rare gas discharge fluorescent lamp, and a pulse signal source that controls the switching element in such a condition that the rate of open time to a period is higher than 8% but lower than 70% and the open time is shorter than 150 μsec within a period, whereby any additional preheating circuit is obviated for preheating the filament, and a rare gas discharge fluorescent lamp having high efficiency in brightness and lighting effect is made possible.

A rare gas discharge lamp device according to another embodiment of the present invention is constructed such that it comprises a rare gas discharge fluorescent lamp wherein rare gas is enclosed in the inside of a glass bulb which has a fluorescent layer formed on an inner face thereof and has a pair of electrodes at the opposite ends thereof, a high frequency power source for supplying frequency higher than 3 KHz but lower than 200 KHz, and an electric voltage generating means for applying pulse-like voltage across a pair of electrodes of the rare gas discharge fluorescent lamp, the pulse-like voltage having a period divided into an energization time and an idle time, wherein the energization time is equal to a half period of a wave form applied from said power source and the idle time is odd-number times as long as the half period of the wave form applied from the power source, whereby a rare gas discharge fluorescent lamp having high efficiency in brightness and lighting effect is made possible.

And further, a rare gas discharge lamp device according to further embodiment is constructed such that it comprises a rare gas discharge fluorescent lamp wherein rare gas is enclosed in the inside of a glass bulb which has a fluorescent layer formed on an inner face thereof and has a pair of electrodes at the opposite ends thereof, a high frequency power source for supplying frequency higher than 3 KHz but lower than 200 KHz, and an electric voltage generating means for applying pulse-like voltage across a pair of electrodes of the rare gas discharge fluorescent lamp by alternatively changing respective polarities, the pulse-like voltage having a period divided into an energization time and an idle time, wherein the energization time is equal to a half period of a wave form applied from the power source and the idle time is integral-number times as long as the half period of the wave form applied from the power source, whereby a rare gas discharge fluorescent lamp having high efficiency in brightness and lighting effect is made possible.

Although the invention has been described in its preferred form with a certain degree of particularity, obviously many changes and variations are possible therein. It is therefore to be understood that the invention may be practiced otherwise than as specifically described herein without departing from the spirit and scope thereof.

What is claimed:

1. A rare gas discharge fluorescent lamp device comprising;

a rare gas discharge fluorescent lamp wherein rare gas is enclosed in the inside of a glass bulb which has a fluorescent layer formed on an inner face thereof and has a pair of electrodes at the opposite ends thereof, a high frequency power source for supplying a high frequency signal having a frequency higher than 3 KHz but lower than 200 KHz, and an electric voltage generating means for receiving said high frequency signal from said high frequency power source, converting said high frequency signal into a pulse-like voltage and applying said pulse-like voltage across said pair of electrodes of said rare gas discharge fluorescent lamp, said pulse-like voltage having a period divided into an energization time and an idle time, wherein said energization time is equal to approximately a half period of said high frequency signal applied from said power source and said idle time is approximately an odd-number times as long as said half period of the high frequency signal applied from said power source.

2. A rare gas discharge fluorescent lamp device as claimed in claim 1, wherein said electric voltage generating means comprises a switching element, a control means for controlling said switching element, a first diode connected in parallel to said rare gas discharge fluorescent lamp, and a second diode connected in series to said switching element forming a series combination, said series combination of said second diode and said switching element connected in parallel to said rare gas discharge fluorescent lamp, wherein polarities of said first and said second diodes are opposite to each other relative to said parallel connection of said first diode and said series combination to said rare gas discharge fluorescent lamp.

3. A rare gas discharge fluorescent lamp device as claimed in claim 1, wherein one of said electrodes of said rare gas discharge fluorescent lamp is a cathode, said cathode being a hot cathode filament.

4. A rare gas discharge fluorescent lamp device comprising;

a rare gas discharge fluorescent lamp wherein rare gas is enclosed in the inside of a glass bulb which has a fluorescent layer formed on an inner face thereof and has a pair of electrodes at the opposite ends thereof, a high frequency power source for supplying a high frequency signal having a frequency higher than 3 KHz but lower than 200 KHz, and an electric voltage generating means for receiving said high frequency signal from said high frequency power source, converting said high frequency signal into a pulse-like voltage and applying pulse-like voltage across said pair of electrodes of said rare gas discharge fluorescent lamp, said pulse-like voltage having a period divided into an energization time and an idle time, wherein said energization time is approximately equal to a half period of said high frequency signal applied from said power source and said idle time is approximately an integral-number times as long as said half period of said high frequency signal applied from said power source.

5. A rare gas discharge fluorescent lamp device as claimed in claim 4, wherein said electric voltage generating means comprises two switching elements, two control means for respectively controlling said two switching elements, and two diodes serially connected to respective ones of said two switching elements to form two series combinations, each of said series combinations of a diode and a switching element respectively being connected to said rare gas discharge fluorescent lamp in parallel, wherein polarities of said diodes are opposite to each other relative to said parallel connection of said first and second diodes to said rare gas discharge fluorescent lamp.

6. A rare gas discharge fluorescent lamp device as claimed in claim 4, wherein the pair of electrodes of said rare gas discharge fluorescent lamp are both made of filament.

* * * * *